US012584721B2

(12) United States Patent
Sullivan

(10) Patent No.: US 12,584,721 B2
(45) **Date of Patent: *Mar. 24, 2026**

(54) DETONATOR FOR A PERFORATING GUN ASSEMBLY

(71) Applicant: XConnect, LLC, Denver, CO (US)

(72) Inventor: Shelby L. Sullivan, Minot, ND (US)

(73) Assignee: XConnect, LLC, Denver, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/054,267

(22) Filed: Feb. 14, 2025

(65) Prior Publication Data

US 2025/0244115 A1 Jul. 31, 2025

Related U.S. Application Data

(60) Division of application No. 18/514,581, filed on Nov. 20, 2023, now Pat. No. 12,385,728, and a continuation-in-part of application No. 18/301,107, filed on Apr. 14, 2023, now Pat. No. 12,241,342, which is a continuation-in-part of application No. 17/547,016, filed on Dec. 9, 2021, now Pat. No. 11,906,278, and a continuation-in-part of application No. 17/547,053, filed on Dec. 9, 2021, now Pat. No. 11,940,261, which is a continuation-in-part of application No. 17/543,121, filed on Dec. 6, 2021, now Pat. No. 11,913,767, which is a continuation-in-part of application No. 17/175,651, filed on Feb. 13, 2021, now Pat. No. 11,293,737, which is a continuation-in-part of application No.

(Continued)

(51) Int. Cl.

| | |
|---|---|
| ***F42D 1/05*** | (2006.01) |
| ***E21B 43/117*** | (2006.01) |
| ***E21B 43/1185*** | (2006.01) |

(52) U.S. Cl.
CPC ..... *F42D 1/05* (2013.01); *E21B 43/1185* (2013.01); *E21B 43/117* (2013.01)

(58) Field of Classification Search
None
See application file for complete search history.

(56) References Cited

U.S. PATENT DOCUMENTS 11,913,767 B2 * 2/2024 Sullivan ..... F42B 3/10

FOREIGN PATENT DOCUMENTS

WO WO-2018055339 A1 * 3/2018 ..... E21B 43/1185

* cited by examiner

*Primary Examiner* — Reginald S Tillman, Jr.
(74) *Attorney, Agent, or Firm* — Peter L. Brewer; Thrive IP

(57) ABSTRACT

A detonator for a perforating gun. The detonator is used to ignite a detonator cord in a charge tube for a perforating gun assembly, which in turn is used for perforating a wellbore. The detonator includes a cartridge. The cartridge comprises a tubular body having a first end; and a second end. Preferably, the tubular body is fabricated from a metallic material. The detonator also comprises a post proximate the first end of the tubular body. The post is configured to be in electrical communication with a first leg wire connected to an addressable switch. Alternatively, the post is in contact with the end of a detonation pin. The detonator also has a fuse head within the bore of the tubular body, and a fuse wire. The fuse head is in contact with the explosive charge material. The detonator is releasably snapped into a compartment located within the charge tube.

4 Claims, 17 Drawing Sheets

Related U.S. Application Data

16/996,692, filed on Aug. 18, 2020, now Pat. No. 11,402,190.

(60) Provisional application No. 63/508,985, filed on Jun. 19, 2023, provisional application No. 63/481,419, filed on Jan. 25, 2023, provisional application No. 63/384,474, filed on Nov. 21, 2022, provisional application No. 63/340,123, filed on May 10, 2022.

DETONATOR FOR A PERFORATING GUN ASSEMBLY

STATEMENT OF RELATED APPLICATIONS

The present application is filed as a Divisional to U.S. Ser. No. 18/301,107. That application was filed on Apr. 14, 2023, and is titled "Detonator for a Perforating Gun Assembly."

The '107 application claimed the benefit of U.S. Ser. No. 63/508,985 filed Jun. 19, 2023. That application was a provisional patent application and was titled "Detonator for a Perforating Gun Assembly."

The '107 application also claimed the benefit of U.S. Ser. No. 63/384,474 filed Nov. 21, 2022. That application was titled "Detonator for a Perforating Gun Assembly."

The '107 application was also filed as a Continuation-in-Part of U.S. Ser. No. 17/543,121 (1312.0007-US5) filed Dec. 6, 2021. That application was titled "End Plate For A Perforating Gun Assembly."

The '121 application was filed as a Divisional of U.S. Ser. No. 17/175,651 (1312.0007-US3) filed Feb. 13, 2021. That application was titled "Detonation System Having Sealed Explosive Initiation Assembly." The '651 application issued on Apr. 5, 2022 as U.S. Pat. No. 11,293,737.

The '651 application was filed as a Continuation-in-Part of U.S. Ser. No. 16/996,692 filed Aug. 18, 2020 (1312.0007-US2). That application is also entitled "Detonation System Having Sealed Explosive Initiation Assembly." The '692 application issued on Aug. 2, 2022 as U.S. Pat. No. 11,402,190.

Each of these applications is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Technical Field of the Invention

The present disclosure relates to the field of hydrocarbon recovery operations. More specifically, the present subject matter relates to a perforating gun assembly used for the perforation of steel casing in a wellbore. Further still, the present invention relates to a detonator used to ignite a detonator cord in a perforating gun charge tube.

Discussion of the Background

For purposes of this disclosure, U.S. Pat. No. 11,402,190 will be referred to as "the parent application." The parent application has been incorporated herein in its entirety by reference.

In the drilling of an oil and gas well, a near-vertical wellbore is formed through the earth using a drill bit urged downwardly at a lower end of a drill string. After drilling to a predetermined depth, the drill string and bit are removed and the wellbore is lined with a string of casing. An annular region is thus formed between the string of casing and the formation penetrated by the wellbore.

A cementing operation is conducted in order to fill or "squeeze" the annular area with cement along part or all of the length of the wellbore. The combination of cement and casing strengthens the wellbore and facilitates the zonal isolation, and subsequent completion, of hydrocarbon-producing pay zones behind the casing.

In connection with the completion of the wellbore, several strings of casing having progressively smaller outer diameters will be cemented into the wellbore. These will include a string of surface casing, one or more strings of intermediate casing, and finally a string of production casing. The process of drilling and then cementing progressively smaller strings of casing is repeated until the well has reached total depth or "TD." In some instances, the final string of casing is a liner, that is, a string of casing that is not tied back to the surface.

Within the last two decades, advances in drilling technology have enabled oil and gas operators to "kick-off" and steer wellbore trajectories from a vertical orientation to a near-horizontal orientation. The horizontal "leg" of each of these wellbores now often exceeds a length of one mile, and sometimes two or even three miles. This significantly multiplies the wellbore exposure to a target hydrocarbon-bearing formation. The horizontal leg will typically include the production casing.

FIG. 1 is a side, cross-sectional view of a wellbore 100, in one embodiment. The wellbore 100 has been completed horizontally, that is, it is completed with a horizontal leg 156. The wellbore 100 defines a bore 10 that has been drilled from an earth surface 105 into a subsurface 110. The wellbore 100 is formed using any known drilling mechanism, but preferably using a land-based rig or an offshore drilling rig on a platform.

The wellbore 100 is completed with a first string of casing 120, sometimes referred to as a surface casing. The wellbore 100 is further completed with a second string of casing 130, typically referred to as an intermediate casing. In deeper wells, that is, wells completed below 7,500 feet, at least two intermediate strings of casing will be used. In FIG. 1, a second intermediate string of casing is shown at 140.

The wellbore 100 is finally completed with a string of production casing 150. In the view of FIG. 1, the production casing 150 extends from the surface 105 down to a subsurface formation, or "pay zone" 115. As noted, the wellbore 100 is completed horizontally, meaning that a near-horizontal section or "leg" 156 is provided. The production casing 150 extends substantially across the horizontal leg 156.

It is observed that an annular region around the surface casing 120 is filled with cement 125. The cement (or cement matrix) 125 serves to isolate the wellbore 100 from fresh water zones and potentially porous formations around the surface casing 120.

The annular regions around the intermediate casing strings 130, 140 are also filled with cement 135, 145. Similarly, the annular region around the production casing 150 is filled with cement 155. However, the cement 135, 145, 155 is placed behind the respective strings of casings 130, 140, 150 up to the lowest joint of the immediately surrounding casing string. Thus, a non-cemented annular region 132 is typically preserved above the cement matrix 135, a non-cemented annular region 142 may optionally be preserved above the cement matrix 135, and a non-cemented annular region 152 is frequently preserved above the cement matrix 155.

The horizontal leg 156 of the wellbore 100 includes a heel 153 and a toe 154. In this instance, the toe 154 defines the end of the wellbore 100 at total depth (or "TD"). In order to enhance the recovery of hydrocarbons, particularly in low-permeability formations, the production casing 150 along the horizontal section 156 undergoes a process of perforating and fracturing. Due to the exceptionally long lengths of new horizontal wells, the perforating and formation treatment process is carried out in stages.

In one method, a perforating gun assembly 200 is pumped down the wellbore 100 towards the toe 154 at the end of a wireline 240. The perforating gun assembly 200 will include a series of perforating guns (shown at 210 in FIG. 2), with each perforating gun 210 having sets of charges ready for detonation. The charges associated with one of the perforating guns 210 are detonated, and perforations (not shown) are "shot" into the production casing 150. Those of ordinary skill in the art will understand that perforating guns have explosive charges, typically shaped, hollow, or projectile charges, which are ignited to create holes in the casing (and, if present, the surrounding cement) 150 and to pass at least a few inches and possibly several feet into the formation 115. The perforations create fluid communication with the surrounding formation 115 (or pay zone) so that hydrocarbon fluids can flow into the casing 150.

After perforating, the operator will fracture the formation 115 through the perforations. This is done by pumping treatment fluids into the formation 115 at a pressure above a formation parting pressure. Those of ordinary skill in the art will understand that "formation parting pressure" is a reference to the downhole pressure required to open up the rock formation to receive fluids. This is in contrast to the hydraulic fracturing pressure, or pumping pressure, measured at the surface in psig.

After the fracturing operation is complete, the wireline 240 will be raised within the casing 150 from the surface 105, and the perforating gun assembly 200 will be positioned at a new location (or "depth") along the horizontal wellbore 156. A plug, such as plug 112, is set below the perforating gun assembly 200 using a setting tool 160, and new shots are fired in order to create a new set of perforations. Thereafter, treatment fluid is again pumped into the wellbore 100 and into the formation 115. In this way, a second set (or "cluster") of fractures is formed away from the horizontal leg 156 of the wellbore 100.

The process of setting a plug, perforating the casing, and fracturing the formation is repeated in multiple stages until the wellbore 100 has been completed, that is, it is ready for production. In FIG. 1, it can be seen that two separate plugs 112 have been placed along the horizontal leg 156 of the wellbore. Of course, it is understood that the completed horizontal leg 156 of the wellbore 100 may extend many hundreds of feet, with multiple plugs 112 being set between the stages. The plugs 112 may be at 150 foot to 250 foot spacing. A string of production tubing (not shown) is then placed in the wellbore 100 to provide a conduit for production fluids to flow up to the surface 105.

In order to provide perforations for the multiple stages without having to pull the perforating gun assembly 200 after each detonation, the perforating gun assembly 200 employs multiple guns in series. FIG. 2 is a side view of an illustrative perforating gun assembly 200, or at least a portion of an assembly. The perforating gun assembly 200 comprises a string of individual perforating guns 210.

Each perforating gun 210 represents various components. These typically include a "gun barrel" 212 which serves as an outer tubular housing. An uppermost gun barrel (or "gun barrel housing") 212 is supported by an electric wire (or "e-line") 240 that extends from the surface 105 and delivers electrical energy down to the perforating gun assembly 200, also known as a "tool string." Each perforating gun 210 also includes an explosive initiator, or "detonator" (shown in phantom at 229). The detonator 229 is typically a small aluminum housing having an internal resistor. The detonator 229 receives electrical energy from the surface 105 and through the e-line 240, which heats the resistor.

In a typical perforating gun 210, the detonator 229 is a so-called block detonator. This is because the detonator 229 is held in place adjacent a detonator cord by means of a non-conductive block. The detonator cord passes through the block, with the detonator 229 residing at least partially inside of the block adjacent the detonator cord.

In practice, a pair of wires (referred to as "leg wires") extend from an addressable switch to the detonator 229. These wires are frequently connected once the perforating guns 210 are delivered to a well site. This means the wires must be accurately and safely connected in conditions that are sometimes hostile, e.g., conditions of blowing sand, rain, snow, or extreme cold.

Resistors may be connected to bridge wires within the block. When the wires are energized downhole, electrical current passes through the resistors and to a bridge wire, causing the bridge wire to become heated. The bridge wire is a so-called hot voltage wire. The bridge wire is in proximity to a chamber holding an explosive material, such as a nitroamine. The most common explosive is an organic chemical compound known as RDX. This may be referred to as a base charge.

The detonator 229 is in close proximity to a detonator cord. The detonator cord may represent a poly-braid material that holds the RDX explosive, with a nylon or aluminum jacket surrounding the poly-braid material. When the base charge within the detonator 1000 is heated, a small explosion is set off that melts the jackets of the detonator cord and ignites the explosive compound residing therein.

When ignited, the detonator cord initiates one or more shots, typically referred to as "shaped charges." The shaped charges (one shown at 320 in FIG. 3) are held in a charge tube (shown at 300 in FIG. 3) and discharge through openings 312 in the charge tube 300 and opening 215 in the selected gun barrel 212. As the RDX, or other suitable explosive, is ignited, the detonator cord propagates an explosion down its length to each of the charges 320 along the charge tube 300.

The perforating gun assembly 200 may also include short centralizer subs 220. The assembly 200 also includes the charge tubes 300, which reside within the gun barrel housings 212 and are not visible in FIG. 2. In addition, tandem subs 225 are used to connect the gun barrel housings 212 end-to-end. Each tandem sub 225 comprises a metal threaded connector placed between the gun barrels 210. (A complete tandem sub is shown at 400 in FIG. 4 of the parent application.) Typically, the gun barrels 210 will have female-by-female threaded ends while the tandem sub 225 has opposing male threaded ends (indicated at 404 in FIG. 4 of the parent application).

The perforating gun assembly 200 with its long string of gun barrels, which include the housings 212 of the perforating guns 210 and the charge tubes 300, is carefully assembled at the surface 105, and then lowered into the wellbore 100 at the end of the e-line 240. The e-line 240 extends upward to a control interface (not shown) located at the surface 105. An insulated connection member 230 connects the e-line 240 to the uppermost perforating gun 210. Once the assembly 200 is in place within the wellbore, an operator of the control interface sends electrical signals to the perforating gun assembly 200 for detonating the shaped charges 320 and for creating perforations into the casing 150.

As noted in FIG. 1, a setting tool 160 resides at the end of the perforating gun assembly 200. The setting tool 160 may be connected to the lowermost perforating gun 210 by means of a tandem sub 225. The setting tool 160 is used to set the plug 112 along the wellbore 100 at a desired depth. This is typically done by using an igniter which initiates the burning of a power charge.

After the casing 150 has been perforated and at least one plug 112 has been set, the setting tool 160 and the perforating gun assembly 200 are removed from the wellbore 100 and a ball (not shown) is dropped into the wellbore 100 to close the plug 112. When the plug 112 is closed, a fluid (e.g., water, water and sand, fracturing fluid, etc. . . . ) is pumped by a pumping system down the wellbore 100 (typically through coiled tubing) and through the newly-formed perforations for fracturing purposes. For a formation fracturing operation, the pump rate will create downhole pressure that is above the formation parting pressure.

As noted, the above operations may be repeated multiple times for perforating and/or fracturing the casing 150 at multiple depths, corresponding to different stages of the wellbore 100. Multiple plugs 112 may be used for isolating the respective stages from each other during the fracturing phases. When all stages are completed, the plugs 112 are drilled out and the wellbore 100 is cleaned using a circulating tool.

It can be appreciated that a reliable signal must be provided to the detonator to ensure that the charges along the gun barrel are detonated. Currently, detonators are manufactured by filling a small, extruded aluminum tube with explosive material and then crimping a fuse head assembly in place. In this case, the fuse head assembly comprises the two leg wires, the resistors, the bridge wire (forming an ignition point), and a grommet that holds all components in place. Current detonators require wiring and connecting the wire legs by hand. Those of ordinary skill in the art will understand that the wires themselves are a fail point as they can easily break off or pull out of the grommet along the detonator.

Accordingly, a need exists for a detonator that can be easily assembled without need of soldering wires together in the shop or in the field. A need further exists for a detonator that may be pre-wired with the two leg wires of the addressable switch and then dropped into place in a charge tube, ready for run-in into a wellbore. A need further exists for a detonator wherein the detonator may simply be snapped into a compartment along the charge tube of a perforating gun assembly at a well site, thereby placing the detonator in electrical communication with the addressable switch without need of manipulating wires in the field.

SUMMARY OF THE INVENTION

A detonator for a perforating gun is provided. The detonator is used to ignite a detonator cord within a perforating gun assembly. The perforating gun assembly, in turn, is used for perforating a wellbore. The perforating gun assembly has a charge tube holding a plurality of charges, and a gun barrel housing holding the charge tube. The perforating gun assembly also includes an addressable switch which interprets signals sent from the surface.

Beneficially, for the present invention the charge tube has a compartment. The compartment is used to hold the detonator, preferably through a snap-fit or friction fit type arrangement. In this instance, the detonator is in the form of a cartridge. The cartridge may be inserted into the compartment in the field.

The detonator first comprises a tubular body. The tubular body has a first end, and a second end opposite the first end. Preferably, the tubular body is fabricated from a metallic material such as aluminum. The detonator is in the form of a cartridge.

The detonator also comprises a terminal. The terminal resides at the first end of the tubular body and is fabricated from a conductive material. The terminal is configured to be in electrical communication with the addressable switch along the perforating gun assembly. In one aspect, electrical communication is accomplished through a first leg wire extending from the addressable switch. More preferably, electrical communication is obtained by inserting the cartridge into the compartment such that the terminal is in contact with the end of a detonation pin. The detonation pin transmits a detonation signal to the detonator within the compartment.

The terminal may comprise a spring. More preferably, the terminal defines a post. In either instance, the terminal is fabricated from a conductive material such as copper or brass.

In one aspect, the detonator has an upper bore which extends through the post. The upper bore receives a resistor wire. In another aspect, an end of the first leg wire extends into and is connected to an inner wall of the post. In this instance, the resistor wire and the first leg wire may be the same wire.

A lower bore is also preserved along the tubular body. The lower bore houses an explosive charge material below the post.

The detonator also has an initiator. The initiator resides at least partially within the cartridge and is configured to be placed in electrical communication with the addressable switch. This may be done either by means of the first leg wire coming off of the addressable switch, or by contact with a detonation pin. The initiator comprises a resistor. The resistor is in electrical communication with the terminal by means of the resistor wire.

The initiator further includes a ground wire. The ground wire extends from the resistor and is connected to an internal wall of the tubular body.

As noted, the cartridge is designed to be inserted into a compartment within the charge tube. The compartment contains a ground terminal. In one aspect, the ground terminal is in electrical communication with a second leg wire extending from the addressable switch. In this instance, the ground wire is in electrical communication with the second leg wire through the ground terminal and through the tubular body itself. Inserting the cartridge into the compartment places the tubular body in contact with the ground terminal.

In another instance, the second leg wire of the addressable switch is wrapped around or crimped to the tubular body adjacent the ground wire to provide grounding.

In a preferred arrangement, an insulative element is provided as part of the detonator. The insulative element separates the post at the upper end of the cartridge from the lower bore within the tubular body. The insulative material may be fabricated from molded rubber or synthetic rubber or other non-conductive material. In one aspect, the resistor wire extends through the insulative element and down to the resistor. In this instance, the resistor is in contact with the explosive material within the lower bore of the tubular body.

In an alternate embodiment, the initiator comprises two resistors, indicated as a first resistor and a second resistor. The first resistor resides along the insulative element while the second resistor resides within or below the insulative element but above the explosive material. In addition, the initiator includes a catalyst element residing between the first resistor and the second resistor. The catalyst element is placed within the lower bore and is in contact with the explosive material. A fuse wire resides between the first resistor and the second resistor, with the catalyst element residing along the fuse wire.

Optionally, the insulative element further comprises a flange. The flange is located between upper and lower ends of the insulative element. The flange is configured to seat within a compartment of the perforating gun charge tube. In an arrangement, an end of the first leg wire is wrapped around the upper end of the insulative element while an end of the ground wire is wrapped around the lower end of the insulative element. The upper end of the insulative element (with the first leg wire wrapped around it) may be pushed up into the cap, and then the lower end of the insulative element (with the second leg wire wrapped around it) may be pushed down into the tubular body. In this way the wires cannot be pulled from the detonator during operation.

Preferably, the detonator resides within the perforating gun charge tube adjacent a detonator cord. The uniquely configured compartment provides a friction fit or a snap-fit type arrangement for the detonator adjacent the detonator cord. This may be done, for example, through clips. The detonator is snapped into the receptacle within the charge tube by accessing an opening provided along the charge tube.

In a preferred arrangement, the perforating gun is adjacent a carrier end plate. The carrier end plate holds a detonation pin which is in electrical communication with the addressable switch. As noted above, placement of the cartridge into the compartment causes the terminal to be in physical contact with the addressable switch through the detonation pin.

A method of firing charges into a wellbore casing is also provided herein. The wellbore casing resides within the horizontal portion of a wellbore.

In one embodiment, the method first comprises providing a perforating gun assembly. The perforating gun assembly has a gun barrel housing, and a charge tube residing within the gun barrel housing. A plurality of charges reside along the charge tube, with a detonator cord extending to each of the charges within the charge tube. The perforating gun assembly also has an addressable switch.

The method also includes providing a detonator. The detonator comprises a tubular body. The tubular body has an upper end and a lower end. The tubular body is fabricated from a conductive metal such as aluminum and serves as a cartridge.

The detonator also includes a terminal. The terminal resides at the upper end of the tubular body. The terminal is also fabricated from a conductive metal, such as brass. The terminal may be a spring, or it may be a post biased upwardly by a spring.

The detonator also provides a lower bore. The lower bore resides within the tubular body. The lower bore houses an explosive charge material proximate the lower end of the tubular body.

An initiator also resides within the tubular body. The initiator resides at least partially within the lower bore and is in contact with the explosive material. As noted above, the initiator will include a resistor wire, a resistor, and a ground wire.

The method also includes placing the detonator into a compartment within the charge tube. In this step, the terminal is configured to be placed in electrical communication with the addressable switch. The compartment comprises a ground terminal. Placement of the detonator into the compartment places the tubular body in contact with the ground terminal. Preferably, the detonator is placed into the compartment using a friction-fit or snap-fit arrangement.

In one arrangement, the terminal is in electrical communication with the resistor by means of a resistor wire. At the same time, the perforating gun is adjacent a carrier end plate. The carrier end plate comprises a detonation pin in electrical communication with the addressable switch. Placement of the cartridge into the compartment causes the terminal to be in contact with the addressable switch through the detonation pin.

The method may further comprise:

- pumping the perforating gun assembly into the horizontal portion of the wellbore using an electric wireline;
- sending an electrical signal from a surface and down the electric wireline to the perforating gun assembly, wherein the signal reaches the addressable switch; and
- sending an initiation signal from the addressable switch, through the detonation pin, and to the detonator, causing the detonator cord to be ignited and causing the plurality of charges to fire into the wellbore casing.

A separate method is also provided herein, which is a method of preparing a perforating gun assembly. A first step in this method is providing a perforating gun assembly. The perforating gun assembly has a gun barrel housing, a charge tube residing within the gun barrel housing, a plurality of charges residing along the charge tube, and a detonator cord extending to each of the charges within the charge tube. The perforating gun assembly also has an addressable switch, a detonation pin in electrical communication with the addressable switch, and a compartment within the charge tube.

The method also includes providing a detonator. The detonator comprises:

- a tubular body having an upper end and a lower end;
- a terminal residing at the upper end;
- a lower bore within the tubular body housing an explosive charge material proximate the lower end; and
- an initiator in contact with the explosive material.

The method also includes transporting the perforating gun assembly to a well site. After the perforating gun assembly has arrived at the well site, the method comprises placing the detonator into the compartment within the charge tube. In this way, the terminal is in physical contact with an end of the detonation pin.

Preferably, the detonator is placed into the compartment using a friction-fit or snap-fit arrangement.

BRIEF DESCRIPTION OF THE DRAWINGS

So that the manner in which the present inventions can be better understood, certain illustrations, charts, and/or flow charts are appended hereto. It is to be noted, however, that the drawings illustrate only selected embodiments of the inventions and are therefore not to be considered limiting of scope, for the present subject matter may admit to other equally effective embodiments and applications.

DEFINITIONS

Figure 1:
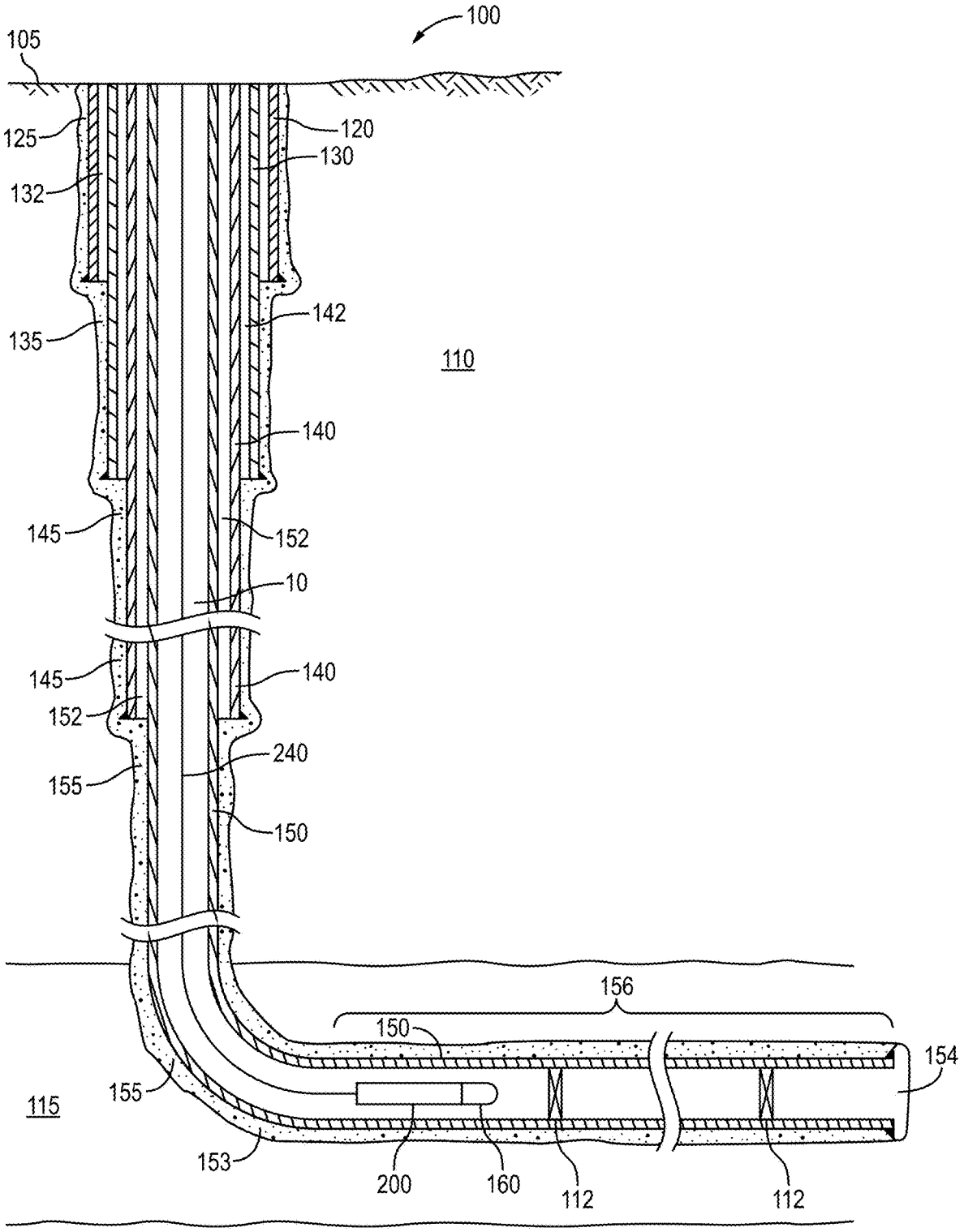
FIG. 1 (Prior Art)
FIG. 1 is a cross-sectional side view of a wellbore. The wellbore is being completed with a horizontal leg. A perforating gun assembly is shown having been pumped into the horizontal leg at the end of a wireline.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, carbon dioxide, and/or sulfuric components such as hydrogen sulfide.

As used herein, the terms "produced fluids," "reservoir fluids," and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, nitrogen, carbon dioxide, hydrogen sulfide, and water.

As used herein, the term "fluid" refers to gases, liquids, and combinations of gases and liquids, as well as to combinations of gases and solids, combinations of liquids and solids, and combinations of gases, liquids, and solids.

As used herein, the term "subsurface" refers to geologic strata occurring below the surface of the earth.

As used herein, the terms "wireline," "cord," and "e-line," when referring to an electrical line, may be used interchangeably to describe electrically conductive cabling used to transmit electrical signals in a wellbore.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example: (i) creation, generation, and/or entrapment of hydrocarbons or minerals; and (ii) execution of processes used to extract hydrocarbons or minerals from the subsurface region.

As used herein, the term "wellbore" refers to a hole in the subsurface made by drilling or insertion of a conduit into the subsurface. A wellbore may have a substantially circular cross-section, or other cross-sectional shapes. The term "well," when referring to an opening in the formation, may be used interchangeably with the term "wellbore."

Reference herein to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment.

DETAILED DESCRIPTION OF CERTAIN EMBODIMENTS

The following description of the embodiments refers to the accompanying drawings. The same reference numbers in different drawings identify the same or similar elements. The following detailed description does not limit the presently disclosed subject matter; instead, the scope of the embodiments herein is defined by the appended claims.

In the following, the terms "upstream" and "downstream" are used to indicate that one gun barrel of a perforating gun may be situated above and one below, respectively. However, one skilled in the art would understand that the presently disclosed subject matter is not limited only to the upstream gun or only to the downstream gun, but in fact, may be applied to either gun. In other words, the terms "upstream" and "downstream" are not necessarily used in a restrictive manner, but only to indicate, in a specific embodiment, the relative positions of perforating guns or other components.

Figure 3:
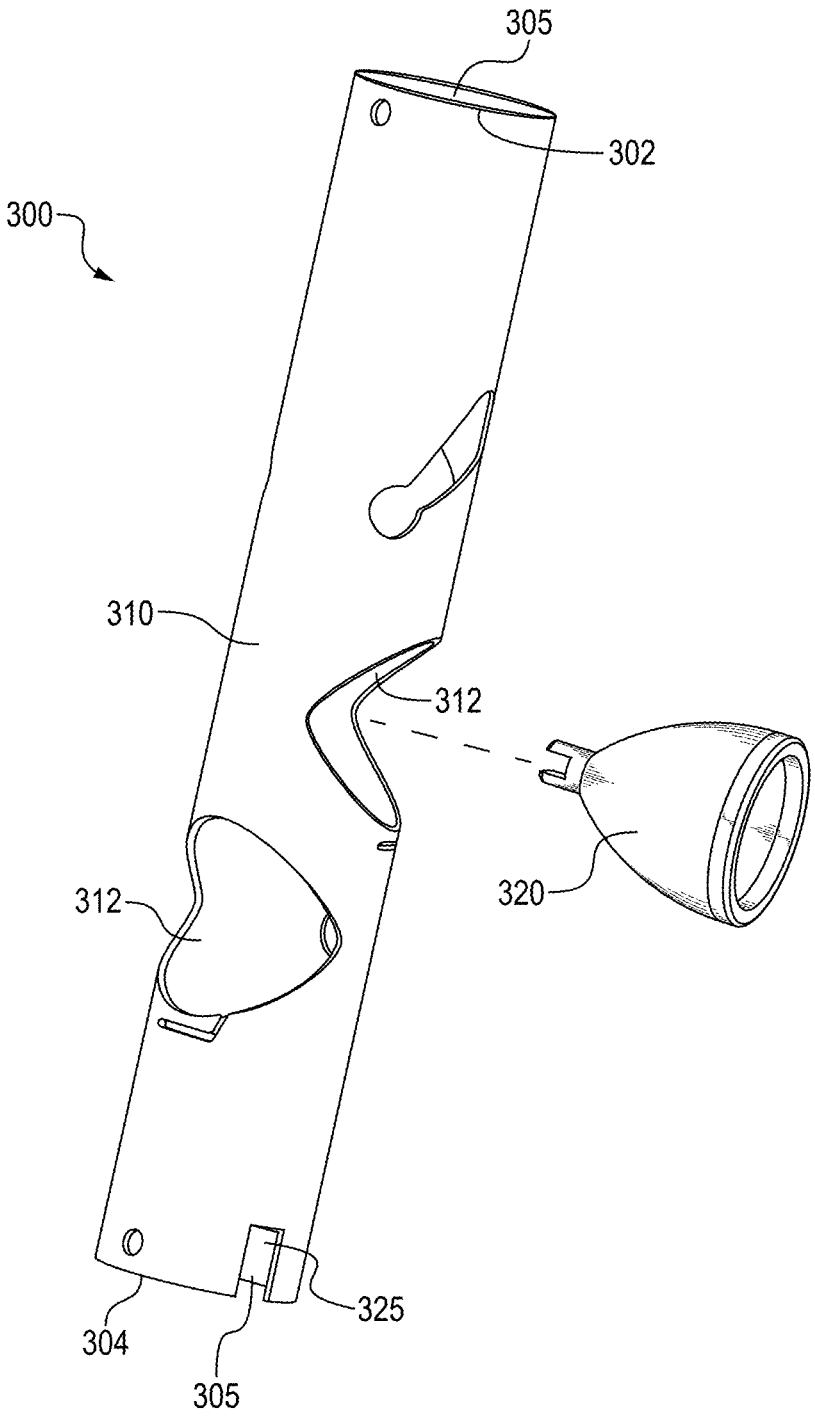
FIG. 3 is a perspective view of an illustrative charge tube for a perforating gun. A charge is shown in separated relation.

FIG. 3 is a perspective view of an illustrative charge tube 300 for a perforating gun 210. The charge tube 300 defines an elongated tubular body 310 having a first end 302 and a second end 304 opposite the first end 302. The charge tube 300 has an inner bore 305 dimensioned to receive charges 320. A single illustrative charge is shown at 320 in exploded-apart relation to the charge tube 300. However, it is understood that the charge tube 300 will typically include several charges 320.

Openings 312 are provided for receiving the charges 320. The openings 312 enable the charges 320 to penetrate a surrounding casing string, such as production casing 150 of FIG. 1, upon detonation.

Figure 4A:
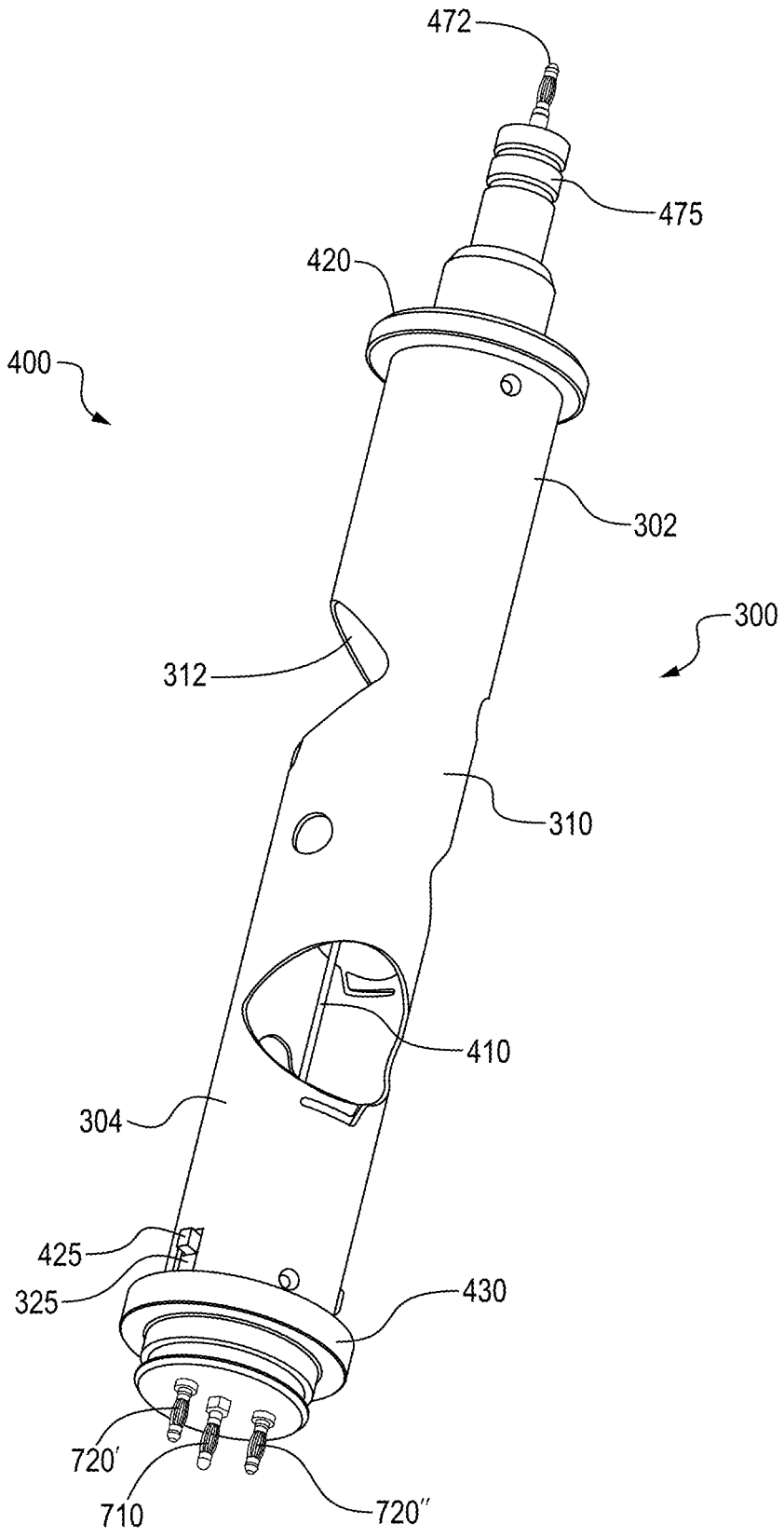
FIG. 4A is a perspective view of the charge tube of FIG. 3. The charge tube has received a top end plate and a bottom end plate. An electric line is shown extending through the charge tube and to the bottom end plate.

FIG. 4A is a perspective view of the charge tube 300 of FIG. 3. In this view, a pair of end plates have been threadedly connected to opposing ends of the charge tube 300, forming a part of a perforating gun assembly 400. These represent a top end plate 420 connected at end 302, and a bottom end plate 430 connected at the bottom end 304. The end plates 420, 430 serve to mechanically enclose the top 302 and bottom 304 ends of the charge tube 300, respectively.

Figure 2:
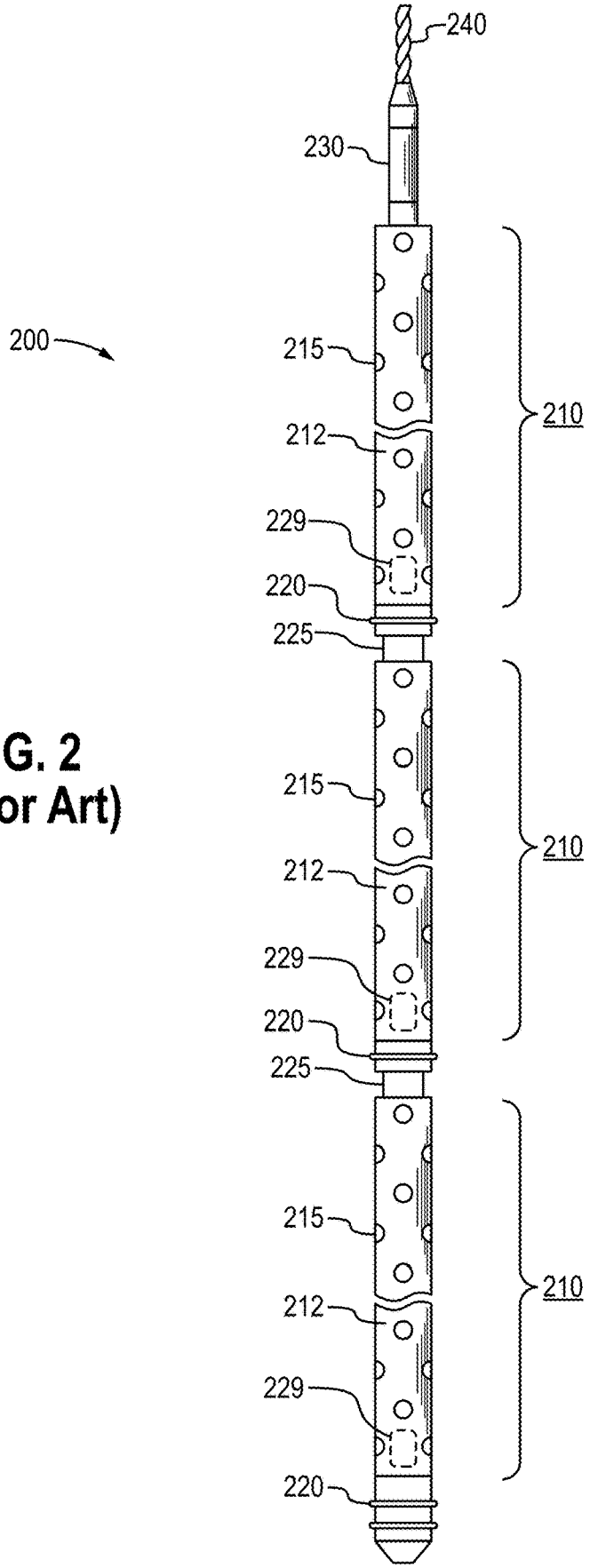
FIG. 2 (Prior Art)
FIG. 2 is a side view of a perforating gun assembly. The perforating gun assembly represents a series of perforating guns having been threadedly connected end-to-end. Tandem subs are shown between gun barrels of the perforating guns, providing the threaded connections.

The end plates 420, 430 help center the charge tube 300 and its charges 320 within an outer gun barrel (not shown in FIG. 4A but shown at 210 in FIG. 2). For this reason, the end plates 420, 430 may also be referred to as "carrier plates" 420, 430. The end plates 420, 430, along with a bulkhead 475, also serve to provide a pressure seal from the explosive charges being detonated in a wellbore, thereby preserving the electronic components residing within adjoining tandem subs 225.

It is understood that each opening 312 along the tubular body 310 of the charge tube 300 will receive and accommodate a respective charge 320. Herein, charge 320 may optionally be referred to as a shaped charge or an explosive charge. Each shaped charge 320, in turn, is designed to detonate in response to an explosive initiation signal ("IE") passed through a detonator wire (such as detonator wire 540 of FIG. 6A or a first leg wire coming off of an addressable switch). It is understood that the charge tube 300 and the shaped charge 320 of FIGS. 3 and 4A are illustrative, and that the presently disclosed embodiments described here within are not limited to any particular type, model, or configuration of charges, charge tubes, or gun barrels unless expressly so provided in the claims.

An electronic detonator (shown schematically at 229 in FIG. 2) and the detonator cord reside inside the charge tube 300. The charge tube 300 and the gun barrel 210 are intended together to be illustrative of any perforating gun, with the understanding that the perforating gun assembly provides for a detonator and detonator cord internal to the charge tube 300.

Extending up from the top end plate 420 is the bulkhead 475. The bulkhead 475 encloses a contact pin (shown at 470 in FIG. 8). An end of the contact pin 470 is indicated at 472. The contact pin 470 is configured to transmit detonation and communication signals from the surface 105 down to addressable switches (not shown) along the gun string 200.

A signal line 410 is seen extending down from the contact pin 470 and through the charge tube 300. The signal line 410 further extends through the bottom end plate 430 and down to a next perforating gun (not shown). A signal carried by the signal line 410 is transmitted through a signal transmission pin 720'. An earlier embodiment of the signal transmission pin 720' is discussed in greater detail in FIGS. 7A, 22A and 22B of the parent application.

At an opposing end of the charge tube 300, the bottom end plate 430 is shown. The bottom end plate 430 has a closed end surface (shown at 435 in FIGS. 5A and 5B). Three pins are shown extending out of the closed end surface 435. These represent a ground pin 710 and two electrical pins 720', 720". In one aspect, ground pin 710 connects to the bottom end plate 430 as an electrical ground, while electrical pins 720', 720" connect to white and green wires, respectively. Electrical pin 720' serves as a signal transmission pin while electrical pin 720" serves as a detonation pin.

Details concerning the ground pin 710 are discussed in connection with FIGS. 9A and 9B of the parent application and need not be repeated herein. For reference, ground pin 710 is seen in the cross-sectional view of FIG. 8 herein. Note that the ground pin 710 does not extend through the end plate 430 but simply screws into the end surface 435.

Figure 4B:
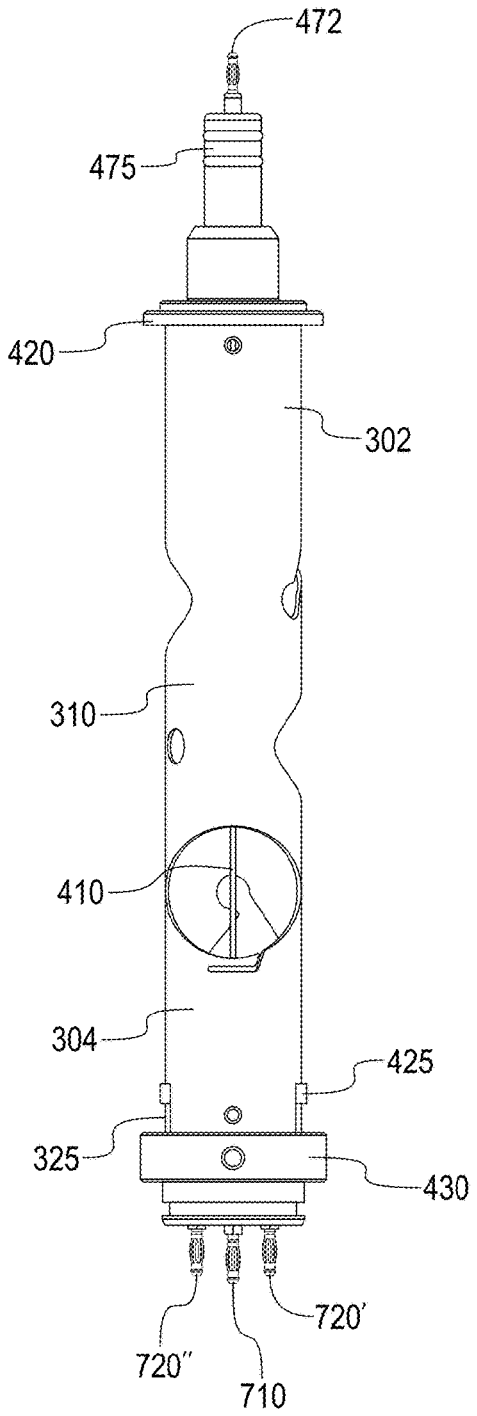
FIG. 4B is a first side view of the charge tube of FIG. 4A.
Figure 4C:
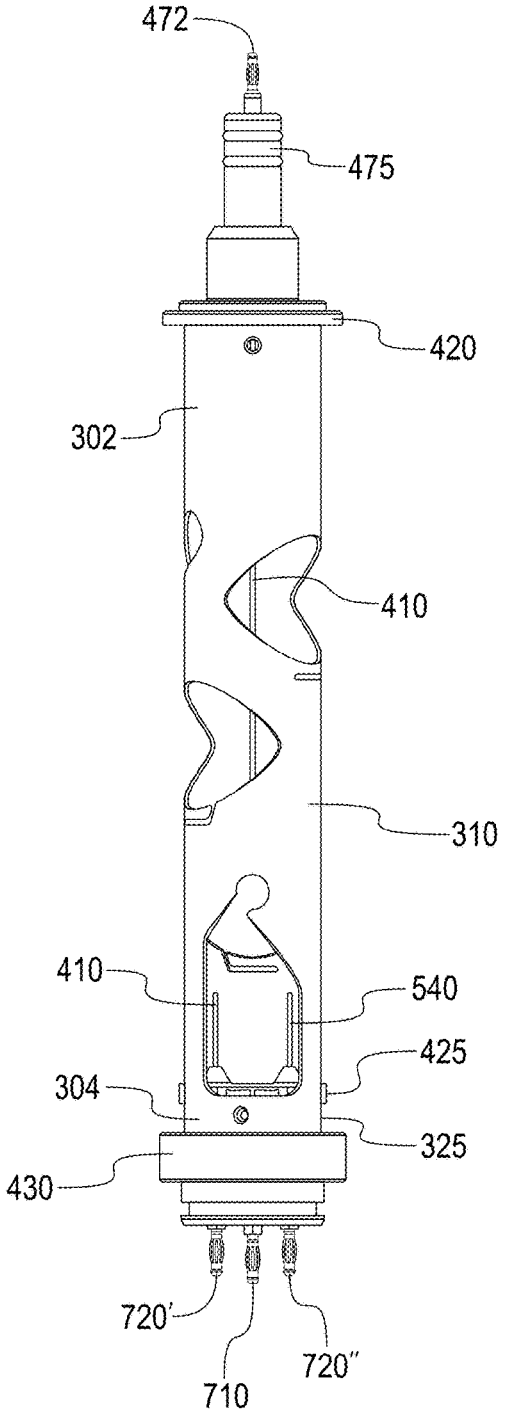
FIG. 4C is a second side view of the charge tube of FIG. 4A, opposite the view of FIG. 4B.

FIG. 4B is a first side view of the charge tube 300 of FIG. 4A. FIG. 4C is a second side view of the charge tube 300 of FIG. 4A, opposite the view of FIG. 4B. Of interest, the charges 320 have been removed, leaving the signal transmission line 410 visible.

Figure 4D:
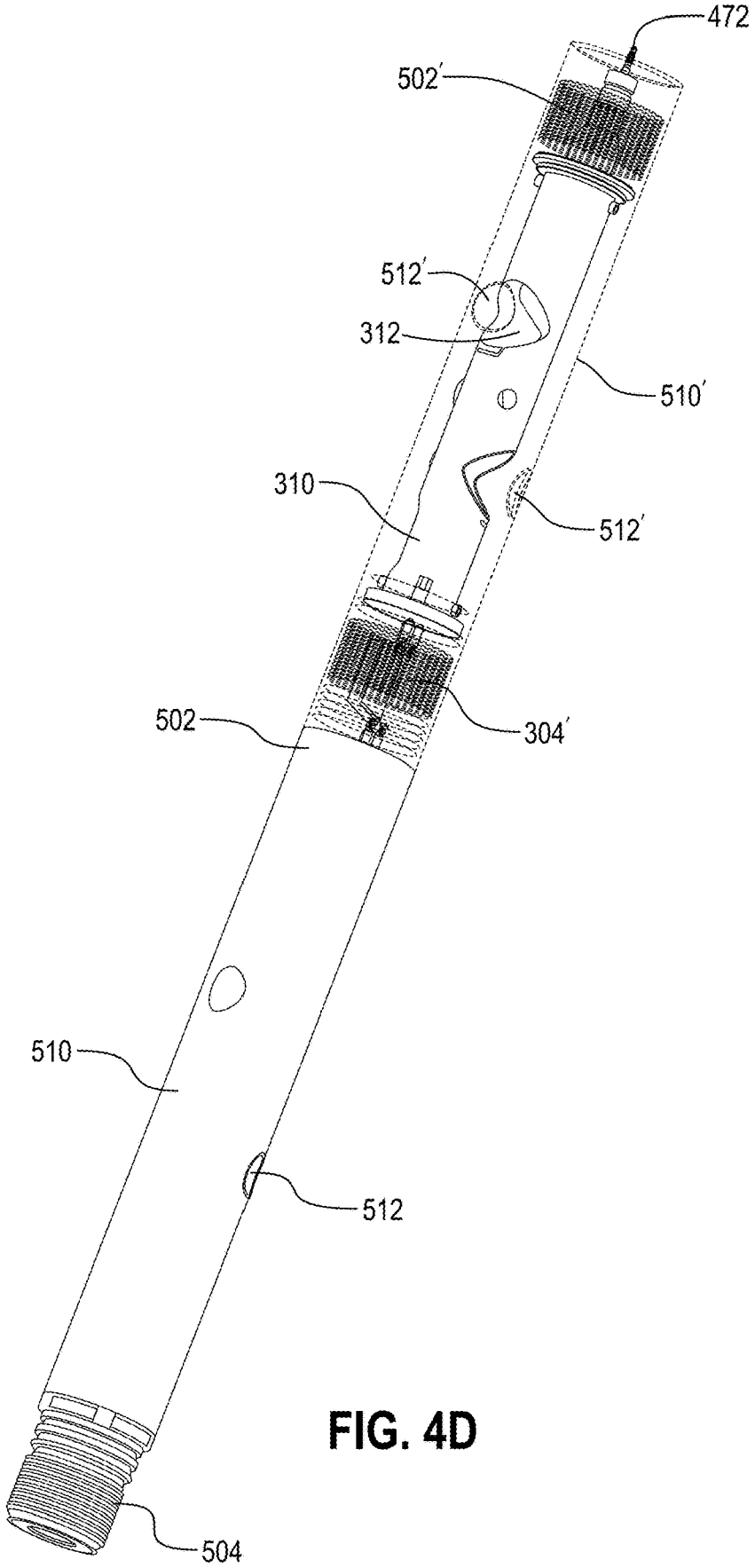
FIG. 4D is a perspective view of the charge tube of FIG. 4A. Here, the charge tube is being slidably received from above within a gun barrel housing.

FIG. 4D is another perspective view of the charge tube 300 of FIG. 3. Here, the charge tube 300 is being slidably received from above within a gun barrel housing 510. The gun barrel housing 510 has an upper end 502 and a lower end 504. The gun barrel housing 510 has a length that is generally conterminous with a length of the charge tube 300. The gun barrel housing 510 includes openings 512 that align with openings 312 of the tubular body 310 when the gun barrel housing 510 is slid in place over the charge tube 300.

In the view of FIG. 4D, the gun barrel housing 510 is shown in phantom when placed over the charge tube 300. The upper end of the gun barrel housing 510 is indicated at 502' while the lower end is shown at 504'. Openings, also referred to as scallops along the gun barrel housing 510, are provided at 512'. It is understood that a joining of the charge tube 300 and the gun barrel housing 510 typically takes place at the shop before delivery of a perforating gun assembly 400 to a well site.

In the arrangement of FIGS. 4A through 4D, the tubular body 310 and gun barrel housing 510 are shown downstream from the contact pin 470. However, it is understood that a separate charge tube 300 and gun barrel housing 510 reside upstream from the contact pin 470. Similarly, separate charge tubes 300 and gun barrel housings 510 reside downstream from the pins 710, 720', 720", forming what may be a long series of perforating guns 210 in a perforating gun assembly 400.

Figure 5A:
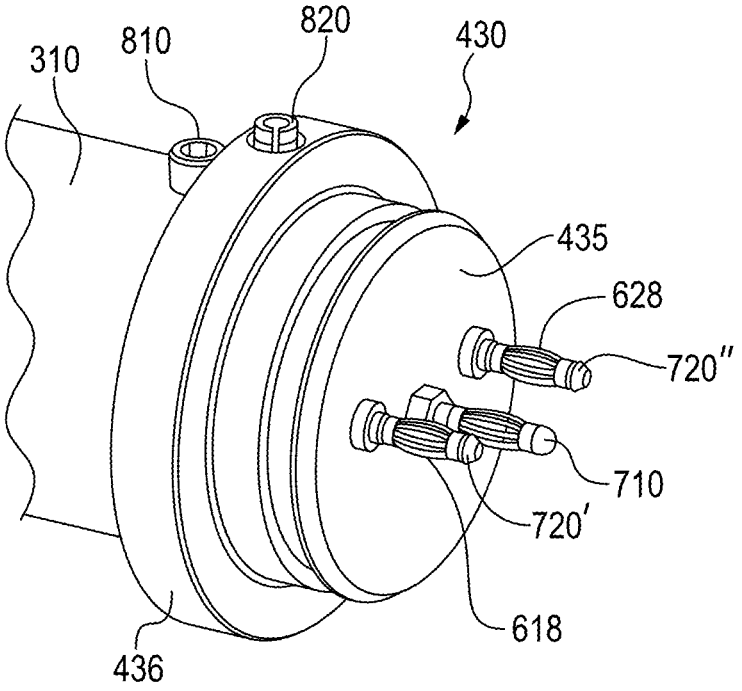
FIG. 5A is a first perspective view of the bottom end plate of FIG. 4A. The bottom end plate is connected to the charge tube. Three electrical pins are shown extending out of the end plate.

FIG. 5A is a first perspective view of the bottom end plate 430 of FIG. 4A. The end plate 430 is slidably connected to the tubular body 310 of the charge tube 300 at end 304. A bolt 810 threadedly connects a proximal end 432 of the end plate 430 to the lower end 304 of the charge tube 300.

Figure 5B:
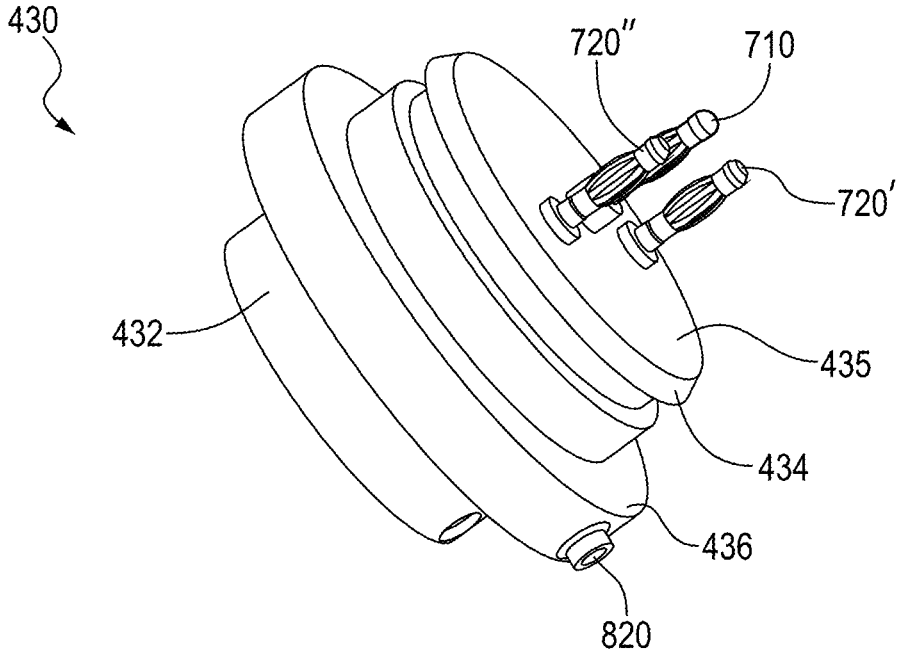
FIG. 5B is a second perspective view of the bottom end plate of FIG. 4A. The charge tube has been removed for illustrative purposes.

FIG. 5B is a second perspective view of the bottom end plate 430. In this view, the proximal end 432 and distal end 434 of the carrier plate 430 are visible. Also shown is the closed end surface 435 and a central flange 436. The central flange 436 receives the lowermost end 504 of the gun barrel housing 510. The central flange 436 also receives bolt 820. This may be used to secure the gun barrel housing 510 to the end plate 430. Of interest, the ground pin 710 and electrical pins 720', 720" are visible.

Note that each of the electrical pins 720', 720" extends into the bottom end plate 430. As demonstrated in FIG. 8, each pin 720', 720" is received within a bulkhead 610, 620, respectively. Thus, end plate 430 contains two through-openings, each of which receives a bulkhead for securing an electrical pin. Because the pins 720' and 720" and their associated bulkheads 610, 620, are extremely small (certainly smaller than bulkhead 475 of FIG. 4A), the bulkheads 610, 620 may be referred to as "mini-bulkheads."

In the present disclosure, a unique "bridged" bulkhead assembly is optionally provided. The bridged bulkhead assembly provides an efficient way to install pre-wired pins into the carrier end plate 430 for field-connection with the addressable switch (shown at 760 in FIG. 8).

Figure 6A:
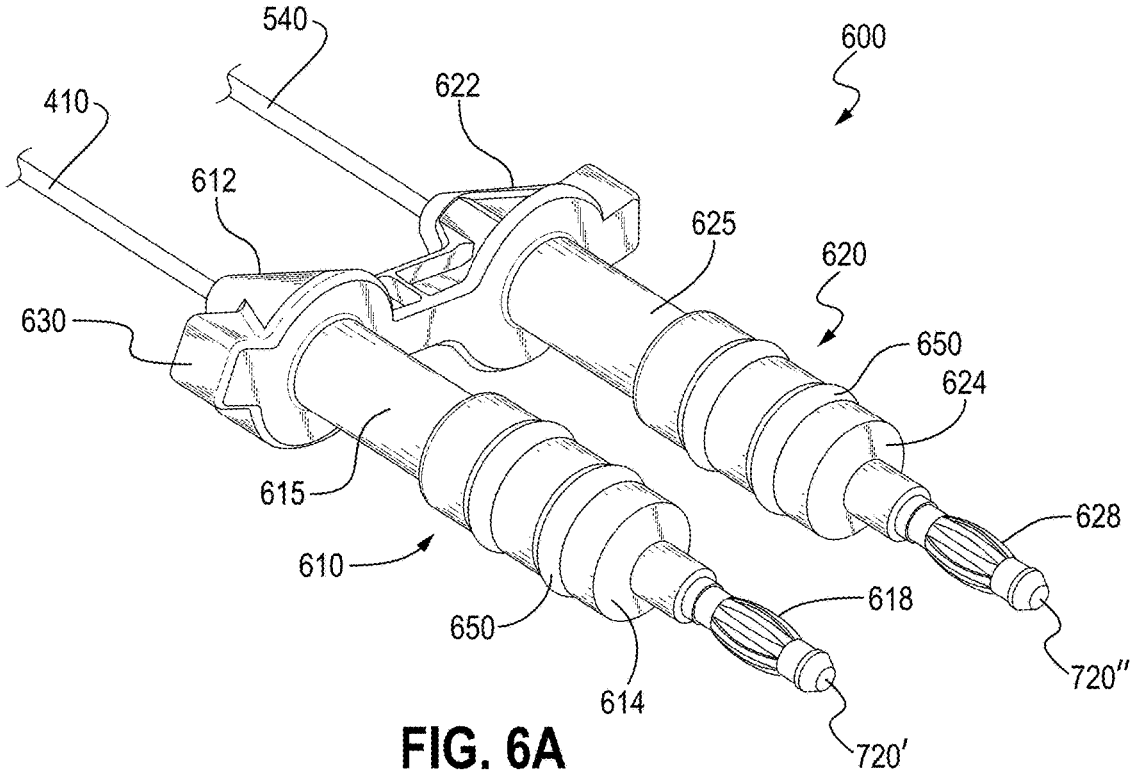
FIG. 6A is a first perspective view of a bridged bulkhead assembly. The bulkhead assembly holds a signal transmission pin and a separate detonation pin.

FIG. 6A is a first perspective view of a bridged bulkhead assembly 600 of the present invention, in one embodiment. The bulkhead assembly 600 holds the signal transmission pin 720' and the detonation pin 720".

Figure 6B:
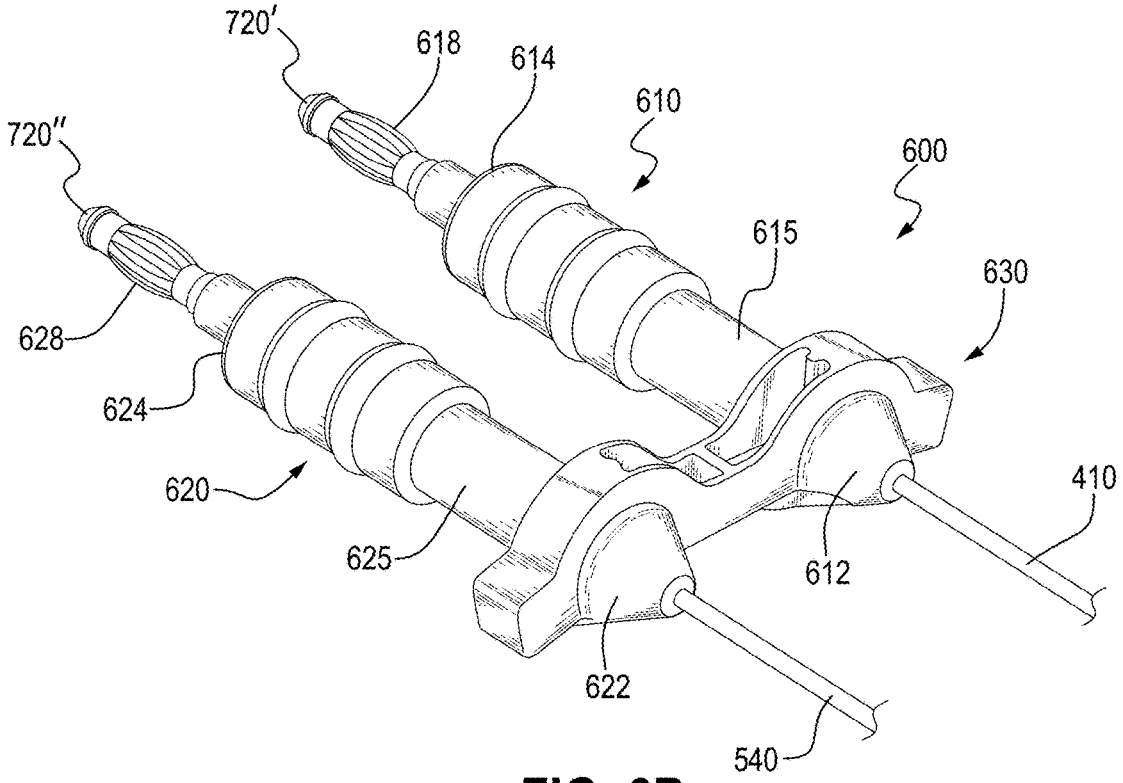
FIG. 6B is a second perspective view of the bridged bulkhead assembly of FIG. 6A. Here, the view is seen from an end opposite that of FIG. 6A.

FIG. 6B is a second perspective view of the bridged bulkhead assembly 600 of FIG. 6A. Here, the view is seen from an end that is opposite the end of FIG. 6A. Note that the bulkhead assembly 600 has also been flipped upside down relative to FIG. 6A.

In each of FIGS. 6A and 6B, a first bulkhead is shown at 610, while a second bulkhead is shown at 620. Bulkhead 610 has a first end 612, and a second end 614 opposite the first end 612. Similarly, bulkhead 620 has a first end 622, and a second end 624 opposite the first end 622. Bulkhead 610 is made up of body 615 while bulkhead 620 comprises body 625. Each of bodies 615, 625 is fabricated from an electrically non-conductive material. In one aspect, the bodies 615, 625 are fabricated through an additive manufacturing process.

Signal transmission line 410 feeds into the first end 612 of the first bulkhead 610. The signal transmission line 410 is securely connected to a first end of the signal transmission pin 720'. This is seen more fully in the cross-sectional view of FIG. 7, discussed below.

In a similar way, a detonator wire 540 extends out from the first end 622 of the second bulkhead 620. The detonator wire 540 is securely connected to a first end of the detonation pin 720". This is also shown more fully in the cross-sectional view of FIG. 7. As discussed below, the detonator wire 540 may also be a first leg wire connected to the detonator 1000, 1400.

Of interest, a second end 618 of the signal transmission pin 720' extends out from the second end 614 of the first bulkhead 610. Similarly, a second end 628 of the detonation pin 720" extends out from the second end 624 of the second bulkhead 620. Each of these second ends 618, 628 represents a banana clip.

FIGS. 6A and 6B also show a bridge 630. The bridge 630 connects and also spaces apart the first 610 and second 620 bulkheads. Again, this is an optional arrangement for the detonator embodiments described herein.

Figure 7:
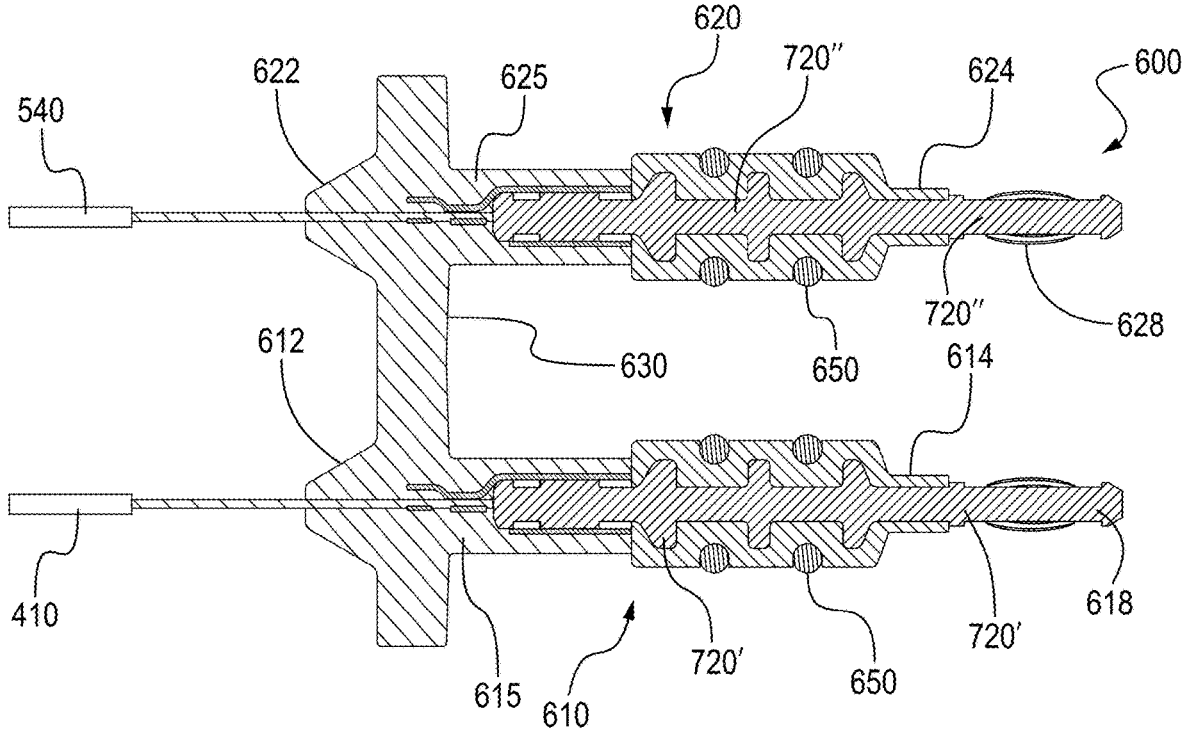
FIG. 7 is a cross-sectional view of the bridged bulkhead assembly of FIGS. 6A and 6B.

FIG. 7 is a cross-sectional view of the bridged bulkhead assembly 600 of FIGS. 6A and 6B. In this view, the signal transmission pin 720' is seen residing within the body 615 of the first bulkhead 610. At the same time, the detonation pin 720" is seen residing within the body 625 of the second bulkhead 620. Each of the signal transmission pin 720' and the detonation pin 720" is an electrically conductive pin. Preferably, each of the pins 720', 720" represents a single pin housed within a respective bulkhead 610, 620, that transmits electrical signals. The brass pins 720', 720" comprise a series of radial steps designed to maintain the pins 720', 720" within the respective bulkheads 610, 620 to ensure a high-pressure barrier when an upstream perforating gun is detonated.

It can be seen in FIG. 7 that the signal transmission line 410 is connected to the signal transmission pin 720' at the first end 612 of the first bulkhead 610. At the same time, the detonator wire 540 is connected to the detonation pin 720" at the first end 622 of the second bulkhead 620. In the present arrangement, the detonator wire 540 may not be used to connect to the detonator 1000, 1400.

In a preferred arrangement, the body 615 of the first bulkhead 610 extends into a first opening of the carrier end plate 430. At the same time, the body 625 of the second bulkhead 620 extends into a second opening of the end plate 430. O-rings 650 encircle the bodies 615, 625, providing a seal within the openings of the end plate 430. As noted in regard to FIGS. 4A and 5A, the end plate 430 is the carrier end plate that resides at a lower end 304 of the perforating gun charge tube 300.

Preferably, each bulkhead 610, 620 includes compliant tabs. The tabs are seen partially at 425 in FIG. 4A. The tabs 425 are configured to mate with slots 325 in the charge tube 300 at end 304. This ensures a proper orientation of the pins 720', 720". Once the bulkheads 610, 620 are installed, the bulkheads 610, 620 are unable to back out of the end plate 430. This removes the need for retainer nuts or other retention parts.

The signal transmission pin 720' transmits electrical signals through the end plate 430 in a first direction. At the same time, the detonation pin 720" transmits the detonation signals back up through the end plate 430 in a second direction opposite the first direction. Preferably, the first direction is downstream while the second direction is upstream. The detonation pin 720" sends a detonation signal to a post 1030 or 1430 of a detonator 1000 or 1400.

Figure 8:
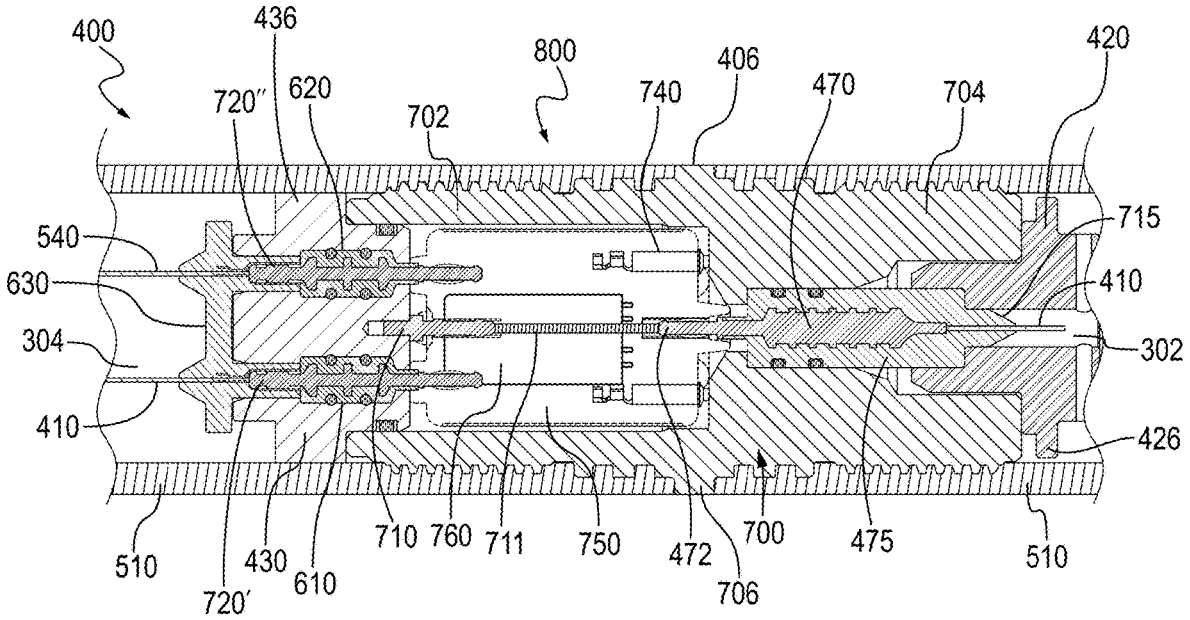
FIG. 8 is a side, cross-sectional view of an explosive initiation assembly. The explosive initiation assembly is threadedly connected at opposing ends to gun barrel housings, forming a portion of a perforating gun assembly. The explosive initiation assembly includes, among other components, a tandem sub, a switch housing, and an addressable switch.

FIG. 8 is a side, cross-sectional view of an explosive initiation assembly 800 of the present invention, in one embodiment. The explosive initiation assembly 800 is threadedly connected at opposing ends to gun barrel housings 510, forming, for example, a part of the perforating gun assembly 200 of FIG. 2.

The explosive initiation assembly 800 first includes a tandem sub 700. The tandem sub 700 represents a short tubular body having male threads at opposing ends 702, 704. Each opposing end 702, 704 is connected to a gun barrel housing 510. Intermediate the opposing ends 702, 704 is a shoulder 706. The gun barrel housings 510 are threaded onto the tandem sub 700 until the gun barrel housings 510 engage with the shoulder 706. Additional details concerning the tandem sub 700 are described in the parent application in connection with FIG. 4.

Residing within the tandem sub 700 is a switch housing 750. Specifically, the switch housing 750 resides within a bore of the tandem sub 700. A perspective view of the switch housing 750 is shown in FIG. 12 of the parent application.

The explosive initiation assembly 800 also includes an addressable switch 760. The addressable switch 760 resides within the switch housing 750. A perspective view of the addressable switch 760 is shown in FIG. 13 of the parent application.

The addressable switch 760 receives electrical signals sent by the operator from the surface 105, through signal transmission pin 720', and filters those signals to identify an activation signal. If an activation signal is identified, then a detonation signal is separately sent for detonation of charges 320 in an adjacent (typically upstream) perforating gun 210. The detonation signal may be sent through the detonation pin 720". Alternatively, where no detonation pin 720" is used, the detonation signal may be sent through a traditional leg wire that is connected to the detonator. In either instance, the detonation signal will energize an initiator, such as a fuse head.

As seen in FIG. 8, the transmission pin 720' and the detonation pin 720" extend through the bottom end plate 430 and into the switch housing 750. Note that neither pin 720' nor 720" is at any time in electrical communication with the detonator 229. Additional details of the switch housing 750 and the addressable switch 760 are also provided in the parent application in connection with FIGS. 12, 13, 16 and 17 and need not be repeated herein.

The tandem sub 700 and its switch housing 750 reside between the bottom end plate 430 and the top end plate 420. Flange members 436, 426 associated with the bottom end plate 430 and the top end plate 420, respectively, abut opposing ends of the tandem sub 700. Beneficially, the end plates 430, 420 mechanically seal the tandem sub 700, protecting the addressable switch 760 from wellbore fluids and debris generated during detonation of the charges 320.

The bottom end plate 430 is shown herein in FIGS. 4A, 5A and 5B, as discussed above. The top end plate 420 is shown in FIGS. 4A, 4B and 4C of the present application and in FIG. 11A of the parent application. As shown in FIG. 11A, the top end plate 420 has a proximal end (shown in FIG. 11A as 622) and a distal end (shown in FIG. 11A as 624). Intermediate the proximal and distal ends is the flange 426. As shown in FIG. 8 herein, the downstream end 704 of the tandem sub 700 abuts and shoulders-out against the flange 426.

The contact pin 470 resides within the non-conductive bulkhead 475. A first (or proximal) end of the contact pin 470 extends into the switch housing 750 while a second (or distal) end of the contact pin 470 extends into the top end plate 420. The contact pin 470 is used to transmit electrical signals through the tandem sub 700 down to the next perforating gun 210 via signal transmission line 410, while the bulkhead 475 provides electrical insulation between the brass contact pin 470 and the surrounding metal tandem sub 700.

Figure 9:
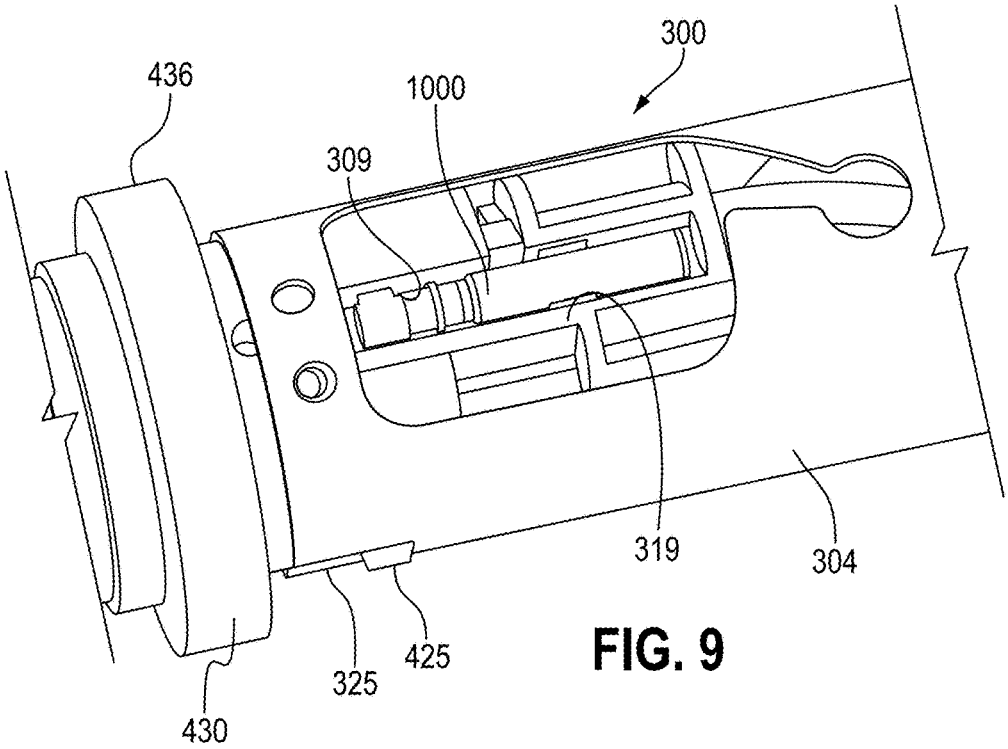
FIG. 9 is a perspective view of a detonator of the present invention, in one embodiment. Here, the detonator is placed within a receptacle of the charge tube for a perforating gun.

FIG. 9 is a perspective view of a detonator 1000 of the present invention, in one embodiment. Here, the detonator 1000 has been placed within the charge tube 300 for a perforating gun 210. More specifically, the detonator 1000 has been snapped into place within a compartment 309, much like, for example, a battery might be snapped into place within the inner housing of a flashlight.

It can be seen that the charge tube 300 is connected to the bottom end plate 430. The compliant tab 425 is seen having been received within slot 325. The post 1030 of the detonator 1000 contacts the second end of the detonation pin 720". Sending an electrical current through the detonation pin 720" and into the detonator 1000 causes an explosive material to be heated. Alternatively, current may be sent directly from the addressable switch 760 through a first leg wire (shown at 1042 of FIG. 12B and 1435 of FIG. 14B as a resistor wire) and to the detonator 1000.

Figure 10:
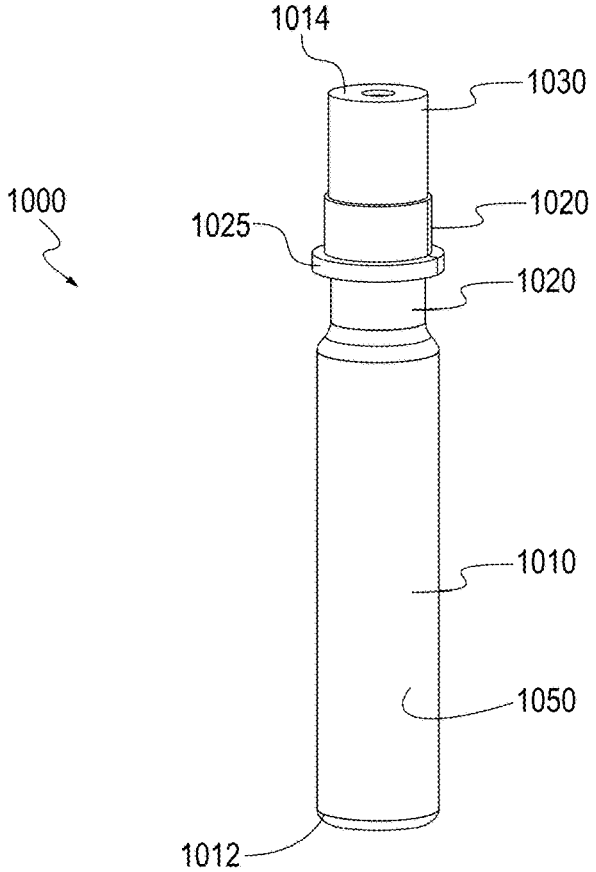
FIG. 10 is a perspective side view of the detonator of FIG. 9.

FIG. 10 is a perspective side view of the detonator 1000 of FIG. 9. The detonator 1000 is configured to be snapped into a compartment 309 that resides within a charge tube 300. The detonator 1000 has a lower end 1012 and an upper end 1014.

The detonator 1000 comprises a tubular body 1010. Preferably, the tubular body 1010 is fabricated from aluminum. The tubular body 1010 includes a lower bore 1050 that houses an explosive material 1005.

Immediately above the tubular body 1010 is an insulating element 1020. The insulating element 1020 defines a non-conductive (or electrically insulating) material such as rubber or synthetic rubber. The insulating element 1020 has a shoulder 1025. The shoulder 1025 is configured to facilitate holding the detonator 1000 in place within the compartment 309 of the charge tube 300.

Above the insulating element 1020 is an upper conductive post 1030. In one aspect, the upper conductive post 1030 is fabricated from brass and acts as a terminal for the detonator 1000. The detonator 1000 and its conductive post 1030 function essentially like a AA battery or, perhaps, as a glass fuse in that they become part of an electrical circuit when snapped into place within the compartment 309. The conductive post 1030 forms one leg of an initiator circuit while the tubular body 1010 forms another leg.

In one aspect, a first leg wire (shown in FIG. 12B at 1335) is connected to the brass post 1030 while a second leg wire (seen in FIGS. 11B and 12B at 1046) is wrapped around a lower end of the insulative element 1020. The first leg wire 1335 may be run through an upper bore 1035 within the conductive post 1030.

In the preferred embodiment, when the detonator cartridge 1000 is snapped into place within the compartment 309 of the charge tube 300, the conductive post 1030 resides near the proximal end 432 of the bottom end plate 430. The conductive post 1030 is then in contact with the detonation pin 720" to receive current on the "hot voltage side." Alternatively, and more preferably, the conductive post 1030 is in contact with the first leg wire 1335 coming off of the addressable switch 760 for delivery of current on the "hot voltage side." A contact 722 (shown in FIG. 15) may be provided for the contact. At the same time, the second leg wire 1046 or 1446 is in electrical communication with a conductive element (shown in FIG. 15 at 725) on the ground side. The conductive elements 722, 725 may fabricated from stamped sheet metal and serves as a ground terminal.

The detonator cartridge 1000 is designed to be inserted into the compartment 309 within the charge tube 300. The compartment 309 contains the ground terminal 725. The ground terminal 725, in turn, is in electrical communication with a second leg wire extending from the addressable switch 760. In this instance, the ground wire 1044 or 1444 is in electrical communication with the second leg wire 1046 or 1446 through the ground terminal 725 and through the tubular body 1010 or 1410 itself.

In another instance, the second leg wire 1046 or 1446 of the addressable switch 760 is wrapped around or crimped to the tubular body 1010 or 1410 adjacent the ground wire 1044 or 1444. In other words, the second leg wire may be connected to the tubular body 1010 or 1410 either directly or through the ground terminal 725.

In operation, the detonator 1000 may be held in place by means of clips 319. The clips 319 are preferably fabricated from a non-conductive and pliable material such as a soft plastic. A separate conductor (conductive element shown in FIG. 15 at 725) is provided adjacent the clips 319. The conductive element 725 may be fabricated from stamped sheet metal, and serves as a ground terminal.

FIG. 11A is a side, plan view of the detonator 1000 of FIG. 10. The overall cartridge shape of the detonator 1000 can be seen.

Figure 11B:
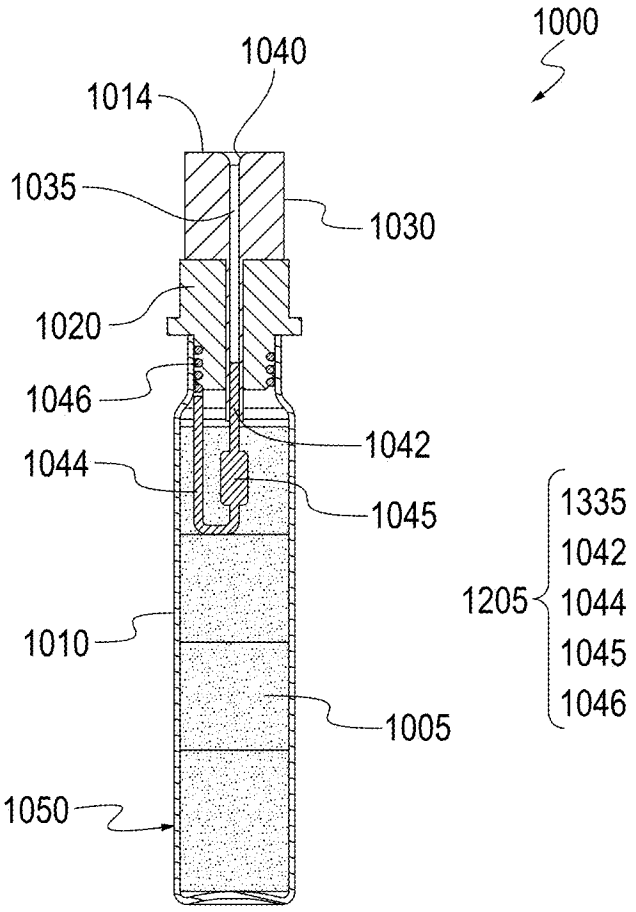
FIG. 11B is a cross-sectional view of the detonator of FIG. 10. The view is taken across Line A-A of FIG. 11A.
Figure 11A:
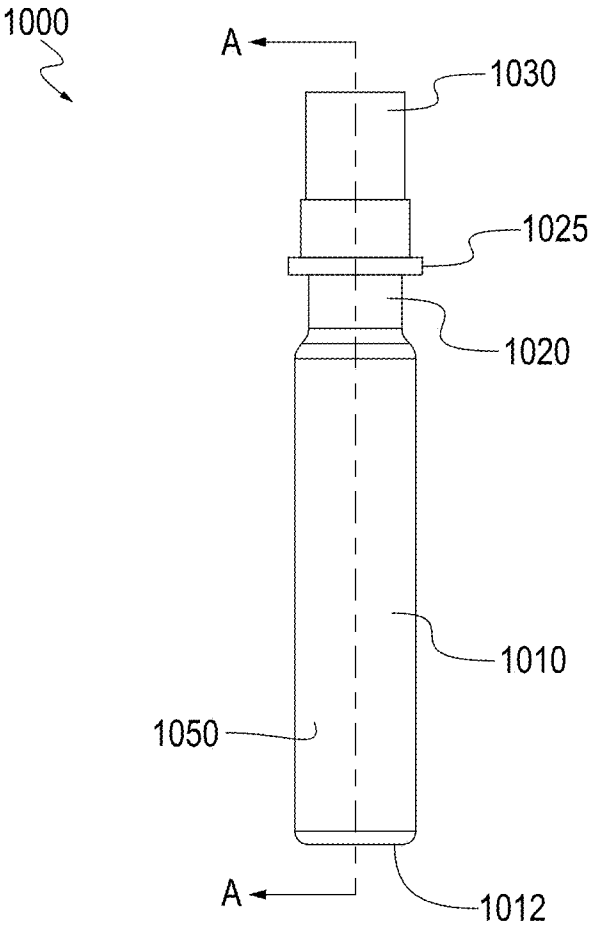
FIG. 11A is a side, plan view of the detonator of FIG. 10.

FIG. 11B is a cross-sectional view of the detonator 1000 of FIG. 10. The view is taken across Line A-A of FIG. 11A. Here, an initiator 1205 is seen. The initiator 1205 comprises the first leg wire 1335, a resistor wire 1042, a resistor 1045, a ground wire 1044, and second leg wire 1046. The upper bore 1035 extends from an opening 1040 at an upper end of the post 1030. The upper bore 1035 is configured to closely receive the first leg wire 1335, which is connected to the resistor wire 1042. (Again, the first leg wire 1335 and the resistor wire 1042 may be the same wire, as an optional way of placing the resistor 1045 in electrical communication with the addressable switch 760.)

Figure 12B:
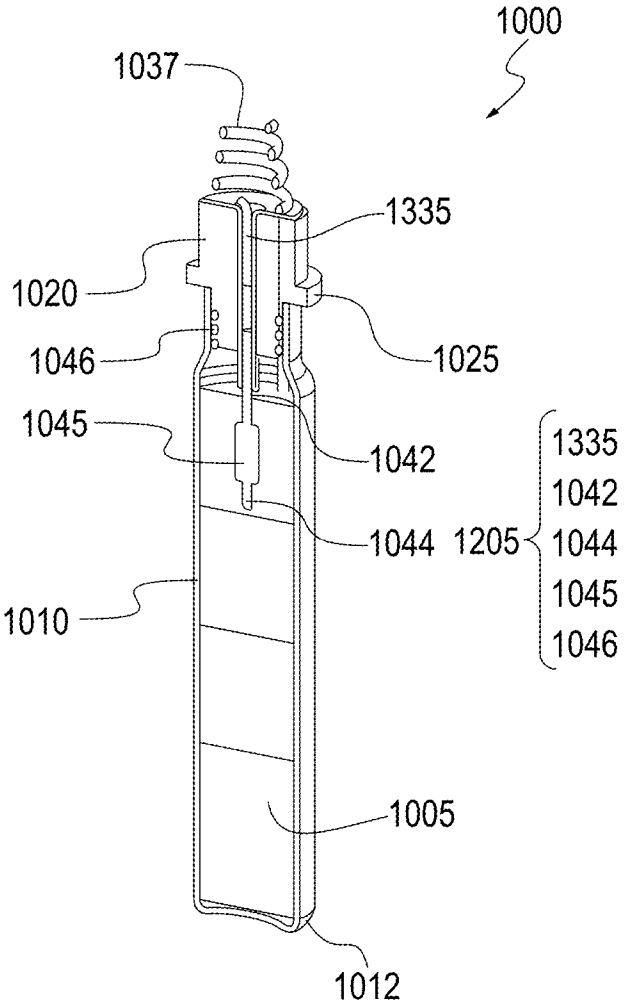
FIG. 12B is a cross-sectional view of the detonator of FIG. 12A.
Figure 12A:
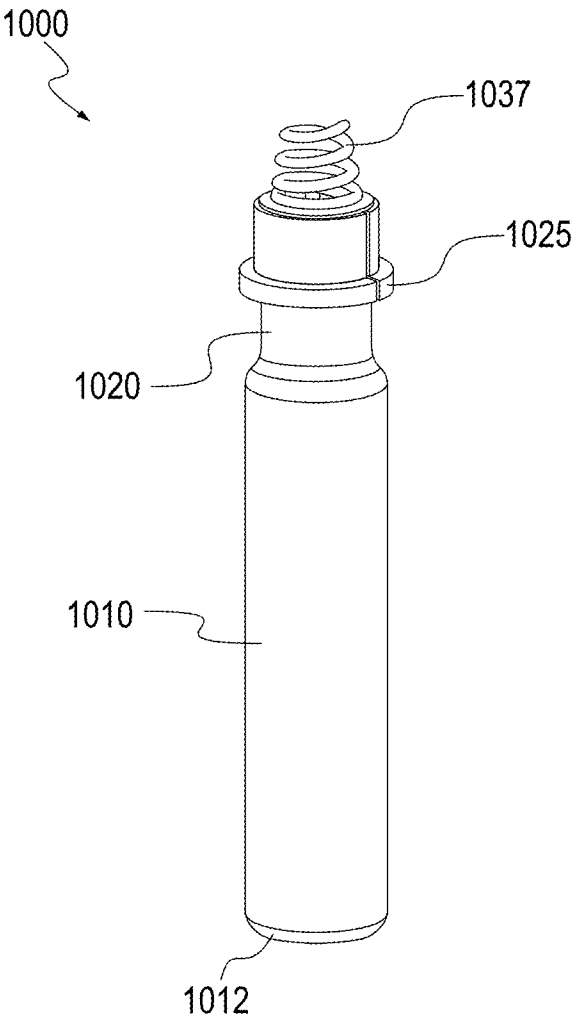
FIG. 12A is a perspective view of the detonator of FIG. 10. Here, a spring is shown residing at an upper end of a cartridge.

FIG. 12A is another side, perspective view of the detonator 1000 of FIG. 10. In this view, the upper conductive post 1030 has been removed, revealing a spring 1037. The spring 1037 biases the upper post 1030 upward towards the bottom end plate 430. In an alternative arrangement, the conductive post 1030 is not used and the spring 1037 itself becomes the terminal. In this instance, the spring 1037 is fabricated from a highly conductive material such as brass or copper and is connected to the resistor wire 1042.

FIG. 12B is a cross-sectional view of the detonator 1000 of FIG. 12A. The spring 1037 is used as the terminal in lieu of the post 1030. The spring 1037 is in electrical communication with the resistor wire 1042. The initiator 1205 is again indicated as a combination of parts 1335, 1042, 1044, 1045, and 1046.

An explosive material 1005 resides within the tubular body 1010 within the lower bore 1050. The explosive material 1005 may be, for example, 1,000 mg of RDX material. In this embodiment, the resistor 1045 resides within or is in contact with the explosive material 1005. For this reason, the resistor 1045 may be referred to as a dual-resistorized fuse head. In any instance, there is no need to connect the detonator cartridge 1000 with a wire in the field as the first 1335 and the second 1046 leg wires are pre-connected to the detonator 1000 in the shop. The detonator 1000 is then simply snapped into place within the compartment 309.

Figure 13B:
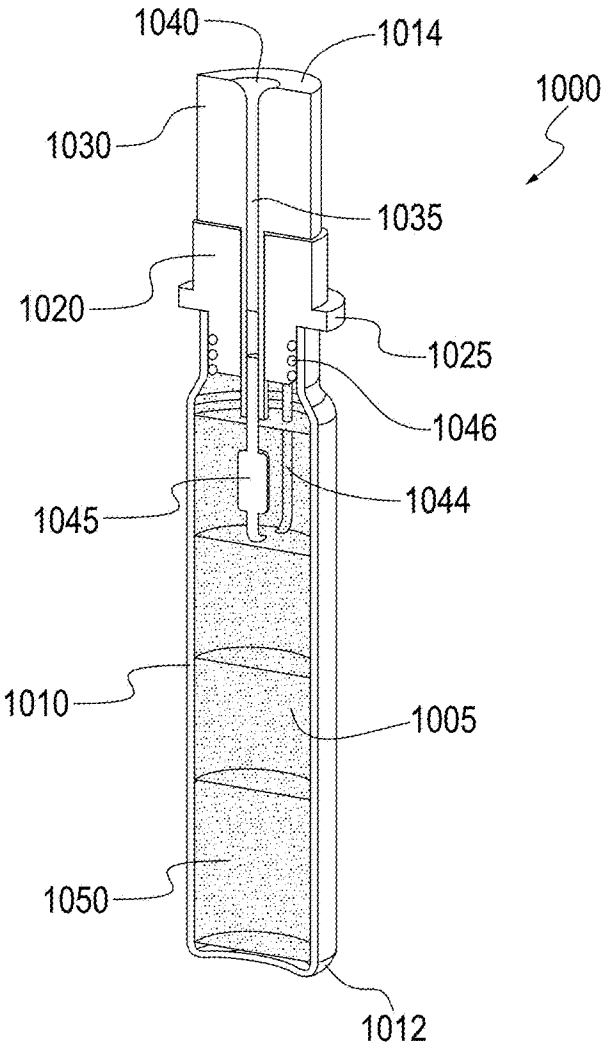
FIG. 13B is a cut-away view of the detonator of FIG. 13A. A post has been installed over the spring.
Figure 13A:
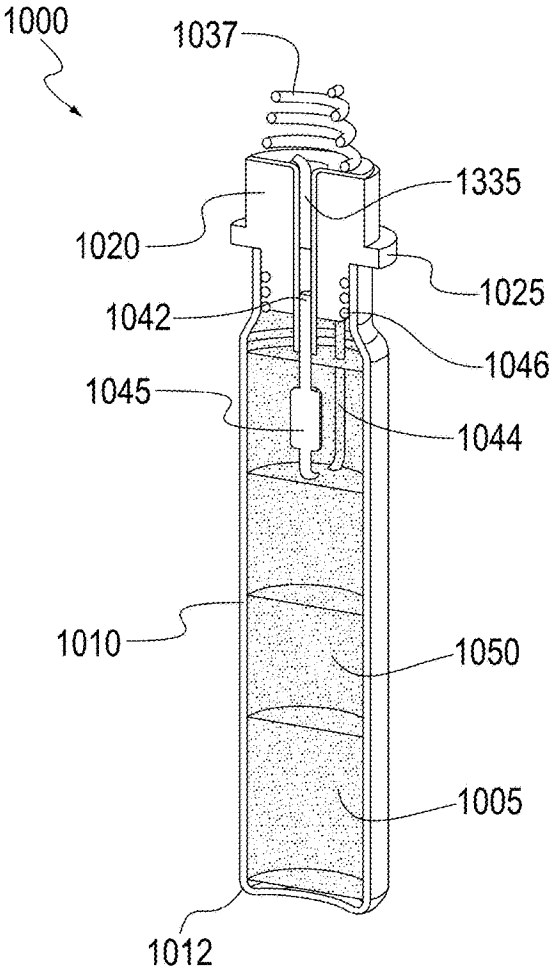
FIG. 13A is a cross-sectional view of the detonator of FIG. 10. Here, the spring at the upper end of the cartridge is visible.

FIG. 13A is a cross-sectional view of the detonator 1000 of FIG. 12A. FIG. 13B is a cut-away view of the detonator 1000 of FIG. 13A. The upper housing 1030 has been installed in lieu of the spring 1037. The post 1030 defines a terminal.

It is observed that the resistor wire 1042 has been received within the opening 1040. The resistor wire 1042 extends down to the resistor 1045. From the resistor 1045, a ground wire 1044 returns back up to the insulative material 1020. The ground wire 1044 is crimped to an internal wall of the tubular body 1010. The ground wire 1044 is in electrical communication with the second leg wire 1046 through the tubular body 1010 itself.

Figure 14B:
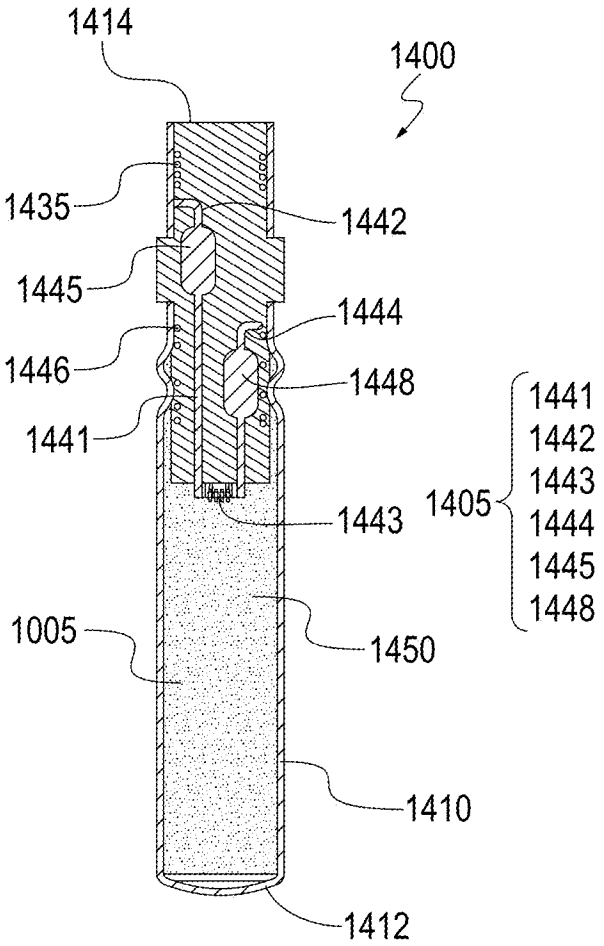
FIG. 14B is a cross-sectional view of the detonator of FIG. 14A, taken across line A-A of FIG. 14A.
Figure 14A:
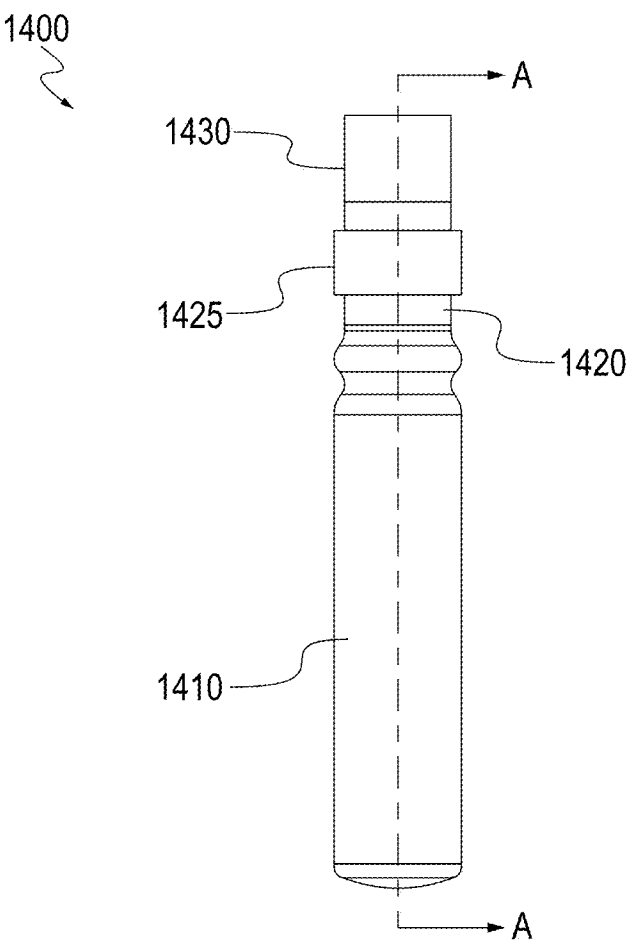
FIG. 14A is a plan view of a detonator in an alternate embodiment.

FIG. 14A is a plan view of a detonator 1400 in an alternate embodiment. FIG. 14B is a cross-sectional view of the detonator 1400 of FIG. 14A, taken across Line A-A of FIG. 14A. The detonator 1400 will be discussed with reference to FIGS. 14A and 14B together.

The detonator 1400 is generally in accordance with the detonator 1000 of FIGS. 10, 11A and 11B. In this respect, the detonator 1400 comprises a tubular body 1410. The detonator 1400 has a lower end 1412 and an upper end 1414, with the tubular body 1010 being sealed at the lower end 1412.

Figure 15:
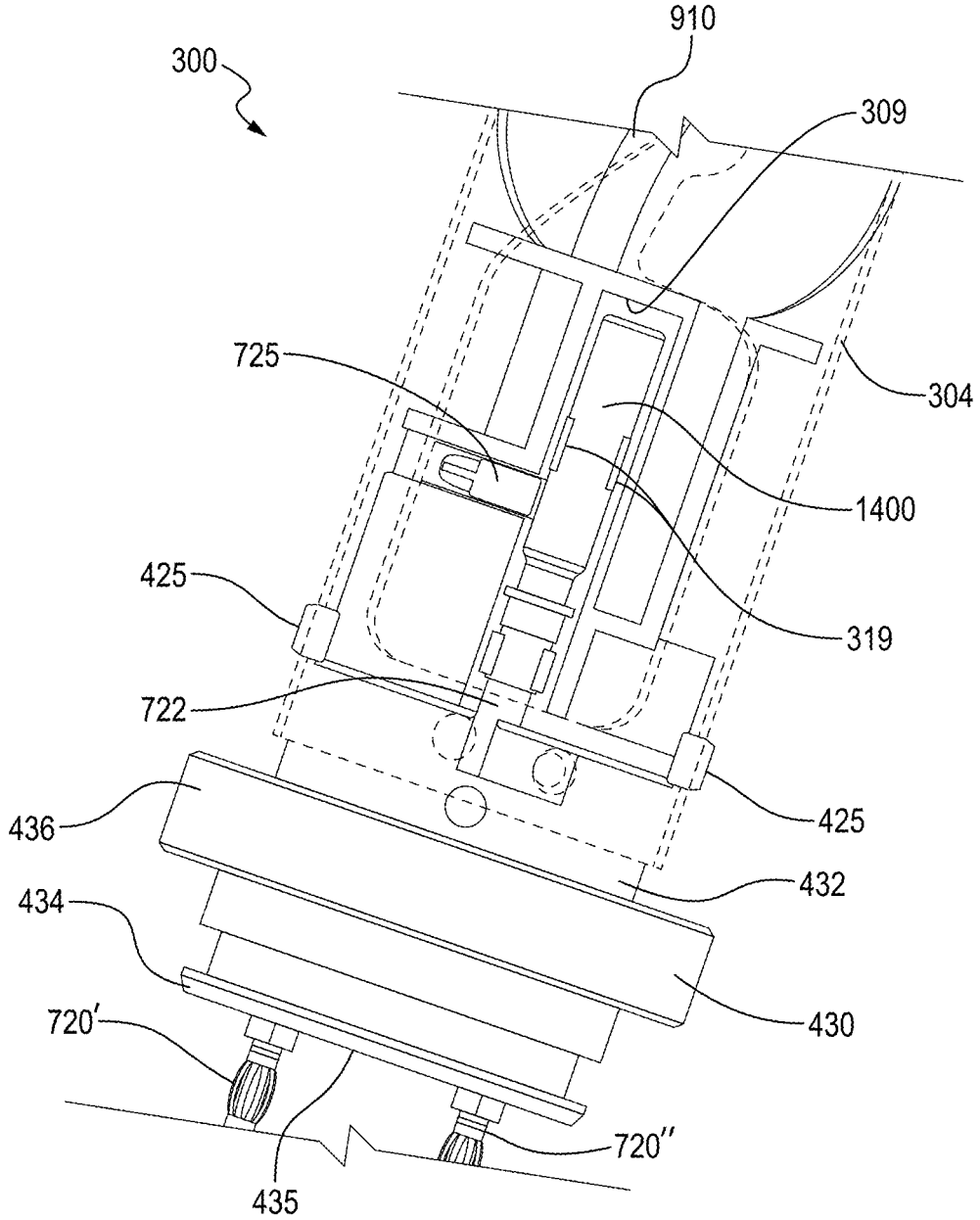
FIG. 15 is another perspective view of the charge tube of FIG. 9. The detonator is more clearly seen residing with a compartment of the charge tube.

Immediately above the tubular body 1410 is an insulating element 1420. The insulating element 1420 defines a non-conductive (or electrically insulating) material such as rubber (including synthetic rubber). The insulating element 1420 has a shoulder 1425, forming a flange. The flange 1425 may facilitate holding the detonator 1400 in place within the compartment 309 of the charge tube 300 as shown in FIG. 15.

Above the insulating element 1420 is an upper conductive housing, or post 1430. When the detonator cartridge 1400 is snapped into place within the charge tube 300, the post 1430 resides near the proximal end 432 of the bottom end plate 430.

Residing within the upper portion of the detonator 1400 is an initiator 1405. The initiator 1405 is made up of two resistors 1445, 1448 and a series of wires 1441, 1442, 1444 connecting the resistors 1445, 1448 to the tubular body 1010. In addition, the initiator 1405 includes a catalyst element 1443.

As shown in FIG. 14B, a first leg wire 1435 is provided along the upper housing 1430. The first leg wire 1435 extends from the addressable switch 760 and is crimped to the inner wall of the post 1430. Also seen is a resistor wire 1442. The resistor wire 1442 is in electrical communication with the first leg wire 1435 by means of the conductive post 1430 itself. Of course, the first leg wire 1435 and the resistor wire 1442 may be the same wire.

The resistor wire 1442 extends to a first resistor 1445. Of interest, the resistor wire 1442 and first resistor 1445 reside entirely within the insulating element 1420.

A lower portion of the tubular body 1010 comprises a bore 1450. The bore 1450 holds the explosive material 1005. It should be noted that the resistor wire 1442 does not extend through the non-conductive (or electrically insulating) material such as rubber 1020. Instead, the resistor wire 1442 is interrupted by the first resistor 1445.

Below the first resistor 1445 is a fuse wire 1441. The fuse wire 1441 extends downward into the explosive material 1005, then circles back up to the second resistor 1448. A ground wire 1444 extends from the second resistor 1448 and crimps into the inner wall of the tubular body 1410. The ground wire 1444 is in electrical communication with the second resistor leg 1446 by means of the tubular body 1410 itself.

Intermediate the first 1445 and second 1448 resistors is a catalyst element 1443. The catalyst element 1443 preferably represents a third resistor. In this arrangement, the catalyst element 1443 extends into the bore 1450 and is in contact with the explosive material 1005. The catalyst element is a part of the initiator 1405.

In one aspect, the post 1430 does not serve an electrically conductive function. Instead, a conductive material is placed within the post 1430 in electrical communication with the resistor wire 1442. The resistor wire 1442 extends into the insulating element 1420 to the first resistor 1445. The first resistor 1445 resides entirely within the insulating element 1420, but sends current along fuse wire 1441 to the catalyst element 1443.

FIG. 15 is a transparent view of the charge tube 300 of FIG. 9. It can be seen that the cartridge that is the detonator 1400 has been snapped into a plastic receptacle within the charge tube 300. In this arrangement, the receptacle represents a pair of elastomeric or plastic clips 319. The detonator 1400 is adjacent to a detonator cord 910.

In a preferred embodiment, the detonator 1400 does not mate within the charge tube 300 via sliding engagement; rather, the detonator 1400 is mated into the plastic receptacle from above. The plastic receptacle, or compartment 309, includes two stamped sheet-metal terminals. One terminal 725 acts as a ground for the detonator 1400, while the other terminal 722 has a crimp location to attach the first leg wire as the "hot" voltage side for the detonator 1400.

In operation, an electrical signal is sent from the surface 105 through the electric line 240. The signal reaches the perforating gun assembly 200. Typically, a lowest perforating gun 210 is designated for first explosive initiation. In that case, the signal passes along the internal signal transmission line 410 through each perforating gun 210 and is then passed along by the transmission pins 720', the addressable switches 760 in each tandem sub 225, and the contact pins 470 until the signal reaches the lowest tandem sub 225 and its addressable switch 760. The addressable switch 760 then recognizes the electrical signal and sends a detonation signal back up through the detonation pin 720" and to the detonator 1000.

Upon reaching the detonator 1000, current travels through the first leg wire 1435, through the resistor wire 1442, through the first resistor 1445, along the fuse wire 1441, through the catalyst 1443, back up to the second resistor 1448, through the ground wire 1444, and to the second resistor leg 1446.

Based on the embodiments of a detonator 1000, 1400 described above, a method of firing charges into a wellbore casing is also provided. In the method, the wellbore casing resides within the horizontal portion of a wellbore.

Figure 16:
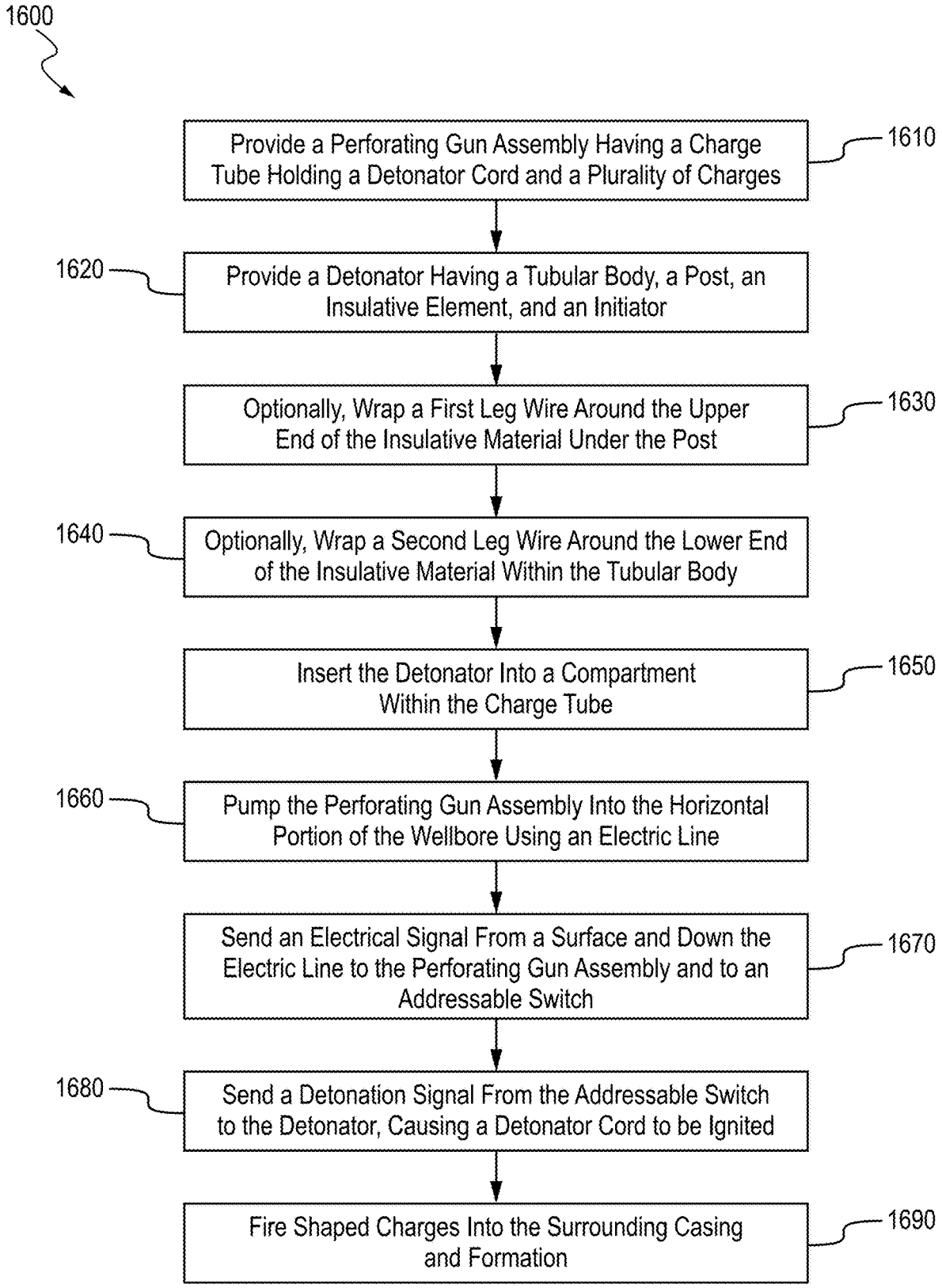
FIG. 16 is a flow chart demonstrating steps for a method of firing shots into a wellbore casing

FIG. 16 is a flow chart demonstrating steps for a method 1600 of firing shots into a wellbore casing. Of course, the shots will penetrate through the casing 150 and into the surrounding formation 115.

In one embodiment, the method 1600 first comprises providing a perforating gun assembly. This is shown in Box 1610 of FIG. 16. The perforating gun assembly includes a gun barrel housing, and a charge tube residing within the gun barrel housing. The perforating gun assembly will also have a plurality of charges residing along the charge tube, as well as a detonator cord extending to each of the charges within the charge tube. Additionally, the perforating gun assembly will include an addressable switch as shown and discussed above in connection with FIG. 8.

The method 1600 also includes providing a detonator. This is seen at Box 1620. The detonator may be in accordance with any of the detonator embodiments described above. In one aspect, the detonator comprises:

- a tubular body (such as tubular body 1410) having an upper end and a lower end;
- a post (such as post 1430) residing at the upper end;
- a lower bore (such as bore 1450) within the tubular body housing an explosive charge material (1005) proximate the lower end (1412); and
- an initiator (such as initiator 1405 and components 1441, 1442, 1443, 1444, 1445, 1448) residing at least partially within the explosive material.

Preferably, the post is fabricated from brass or copper while the tubular body is fabricated from aluminum.

The addressable switch will have two so-called leg wires. In the method, these are first and second leg wires. In one embodiment, each leg wire extends to and is connected to the detonator. The first leg wire is crimped to (or is otherwise in contact with) the post while the second leg wire is crimped to (or is otherwise in contact with) the tubular body of the detonator below the post.

In another embodiment, the first leg wire is crimped to a so-called hot terminal along a compartment of the charge tube, while the second leg wire is crimped to a ground terminal in the compartment. The crimping of the first and second leg wires may be done in the shop before the perforating gun assembly is taken to a well site.

In one aspect, the detonator also includes an insulative element. The insulative element separates the terminal at the upper end of the cartridge from the lower bore within the tubular body. The insulative element may include:

- an upper end having an outer diameter configured to be received within the post, or residing immediately below the post;
- a lower end having an outer diameter configured to be received within an upper end of the tubular housing above the lower bore, or otherwise immediately above the lower bore; and
- a flange between the upper and lower ends.

Together the post, the insulative material and the tubular body form a cartridge.

In the method 1600, the initiator may comprise:

- a resistive wire;
- a catalyst element residing within the lower bore and in contact with the resistive wire and the explosive charge material;
- a fuse wire connected to the catalyst element; and
- a ground wire extending from the catalyst element and grounded to an internal wall of the tubular body at the second leg wire.

Optionally, the method 1600 may further include:

- wrapping the first leg wire around the upper end of the insulative material under the post (shown at Box 1630); and
- wrapping the second leg wire around the lower end of the insulative material within the tubular body such that the ground wire and the second leg wire are in electrical communication with one another (shown at Box 1640).

The method 1600 also comprises placing the detonator into a compartment within the charge tube. This is indicated at Box 1650. With the two leg wires coming off of the addressable switch already connected to the detonator in secure fashion, the operator in the field need only snap the detonator into the compartment in order to prepare the perforating gun assembly. Alternatively, the two leg wires are pre-crimped onto hot and ground terminals. Either way, no crimping of wires for the detonator need take place in the field.

The method 1600 may also include:

- pumping the perforating gun assembly into the horizontal portion of the wellbore using an electric wireline (shown at Box 1660);
- sending an electrical signal from a surface and down the electric wireline to the perforating gun assembly, wherein the signal reaches the addressable switch (shown at Box 1670); and
- sending a detonation signal from the addressable switch to the detonator, causing the detonator cord to be ignited (shown at Box 1680).

The result of sending the activation signal to the igniter is that a power charge is ignited in the charge tube 300, causing the charges to fire into the wellbore casing. This is provided at Box 1690.

In addition to the method of perforating a casing provided above, a method of preparing a perforating gun assembly is also provided herein. The method first comprises providing a perforating gun assembly. In this case, the perforating gun assembly comprises a gun barrel housing, a charge tube residing within the gun barrel housing, a plurality of charges residing along the charge tube, a detonator cord extending to each of the charges within the charge tube, an addressable switch, and a compartment within the charge tube.

The method also includes providing a detonator. The detonator comprises:

a tubular body having an upper end and a lower end;

a terminal residing at the upper end;

a lower bore within the tubular body housing an explosive charge material proximate the lower end; and an initiator.

The method additionally includes placing a first leg wire of an addressable switch in electrical communication with the terminal. The method then includes placing a second leg wire of the addressable switch in electrical communication with the tubular body.

The method further comprises transporting the perforating gun assembly to a well site. After the perforating gun assembly has arrived at the well site, the method includes placing the detonator into the compartment within the charge tube.

In one aspect of the method, the initiator comprises:

a resistor wire in electrical communication with the first leg wire;

a catalyst element residing within the lower bore and in contact with the explosive charge material; and a ground wire extending from the catalyst element and grounded to an internal wall of the tubular body.

The second leg wire may be connected to the ground terminal, or it may be wrapped around the tubular body. Preferably, the compartment comprises a ground terminal in contact with the tubular body. Preferably, the detonator is placed into the compartment using a friction-fit or snap-fit arrangement. Placing the detonator into the compartment causes the ground terminal to contact the tubular body, and causes the post to contact a hot terminal.

It should be understood that this description is not intended to limit the invention; on the contrary, the exemplary embodiments are intended to cover alternatives, modifications, and equivalents, which are included within the spirit and scope of the invention as defined by the appended claims. Further, in the detailed description of the exemplary embodiments, specific details are set forth in order to provide a comprehensive understanding of the claimed invention. However, one skilled in the art would understand that various embodiments may be practiced without such specific details.

Further, variations of the detonator and of methods for using the detonator within a wellbore may fall within the spirit of the claims, below. It will be appreciated that the inventions are susceptible to other modifications, variations, and changes without departing from the spirit thereof.

I claim:

1. An end plate comprising:

a first end defining a first face, with the first face abutting a charge tube of a perforating gun;

a second end opposite the first end, and defining a second face;

an opening along the second face configured to receive an end of a ground pin;

a first through-opening and a second through-opening;

a first bulkhead residing in the first through-opening configured to closely receive a signal transmission pin, wherein the signal transmission pin is configured to transmit electrical signals from the perforating gun, through the end plate, and to an addressable switch;

a second bulkhead residing in the second through-opening configured to closely receive a detonator pin, wherein the detonator pin is configured to transmit a detonation signal from the addressable switch, back up through the end plate, and to a detonator;

and wherein:

the addressable switch comprises a first leg wire and a second leg wire; and the detonator is received within a compartment of the charge tube within the perforating gun.

2. The end plate of claim 1, wherein:

the detonator comprises a terminal;

the detonator is placed within the compartment of the charge tube using a friction-fit or snap-fit arrangement;

the first leg wire is in electrical communication with the detonator pin;

the second leg wire is in electrical communication with a ground terminal in the compartment; and placement of the detonator into the compartment causes the terminal to be in contact with the detonator pin, and a body of the detonator to be in contact with the ground terminal.

3. The end plate of claim 2, further comprising:

a flange residing between the first face and the second face;

and wherein:

the charge tube resides upstream from the end plate;

the charge tube extends over the first face of the end plate and abuts the flange on a first side;

a downstream tandem sub extends over the second face of the end plate and abuts the flange on a second side opposite the first side; and the addressable switch resides within the tandem sub.

4. The end plate of claim 2, wherein: the first leg wire is connected to the detonator pin; and the second leg wire is connected to a ground terminal in the compartment 4.

* * * * *